US008721056B2

(12) United States Patent
Sekiya

(10) Patent No.: US 8,721,056 B2
(45) Date of Patent: May 13, 2014

(54) CONTINUOUS MULTI-NOZZLE INKJET RECORDING APPARATUS

(75) Inventor: Takuro Sekiya, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 1138 days.

(21) Appl. No.: 12/697,864

(22) Filed: Feb. 1, 2010

(65) Prior Publication Data

US 2010/0194829 A1 Aug. 5, 2010

(30) Foreign Application Priority Data

Feb. 2, 2009 (JP) ..... 2009-021382
Dec. 25, 2009 (JP) ..... 2009-295700

(51) Int. Cl.
*B41J 2/02* (2006.01)
*B41J 2/09* (2006.01)

(52) U.S. Cl.
USPC ..... 347/75; 347/77

(58) Field of Classification Search
USPC ..... 347/75, 77
See application file for complete search history.

(56) References Cited

U.S. PATENT DOCUMENTS

| | | | |
|---|---|---|---|
| 3,373,437 | A | 3/1968 | Sweet et al. |
| 3,683,212 | A | 8/1972 | Zoltan |
| 3,747,120 | A | 7/1973 | Stemme |
| 3,946,398 | A | 3/1976 | Kyser et al. |
| 4,723,129 | A | 2/1988 | Endo et al. |
| 7,413,293 | B2 | 8/2008 | Jeanmaire |
| 2003/0016264 | A1 | 1/2003 | Jeanmaire |
| 2004/0017421 | A1 | 1/2004 | Jeanmaire |

FOREIGN PATENT DOCUMENTS

| | | |
|---|---|---|
| JP | 55-51566 | 4/1980 |
| JP | 56-120367 | 9/1980 |
| JP | 56-144168 | 11/1981 |
| JP | 59-87173 | 5/1984 |
| JP | 60-104340 | 6/1985 |
| JP | 60-104341 | 6/1985 |
| JP | 1-99859 | 4/1989 |
| JP | 2001-18422 | 1/2001 |
| JP | 2003-89214 | 3/2003 |
| JP | 2003-266659 | 9/2003 |
| WO | WO2008/143788 A2 | 11/2008 |

OTHER PUBLICATIONS

Japanese official action dated Sep. 3, 2013 in corresponding Japanese patent application No. 2009-295700.

*Primary Examiner* — Kevin S Wood
(74) *Attorney, Agent, or Firm* — Cooper & Dunham LLP

(57) ABSTRACT

A continuous multi-nozzle inkjet recording apparatus includes a multi-nozzle inkjet head including a liquid chamber, an ink nozzle plate, and a heating unit, a gas flow applicator, a cap, and a gutter unit. The ink nozzle plate includes ink jetting nozzles to jet ink column. The heating unit stimulates the pressurized ink at an exit opening of the ink jetting nozzles to separate ink droplets from the ink column. The gas flow applicator applies a gas flow to flying ink droplets. The gas flow applicator includes an opening to jet the gas flow. The cap shields an area of the gas flow from an ambient atmosphere space existing around a transporting and image forming area for the recording medium. The gutter unit catches ink droplets. Ink droplets not caught by the gutter unit are directed onto a recording medium to form an image on the recording medium.

8 Claims, 8 Drawing Sheets

CONTINUOUS MULTI-NOZZLE INKJET RECORDING APPARATUS

CROSS-REFERENCE TO RELATED APPLICATIONS

This application claims priority to Japanese Patent Application Nos. 2009-021382, filed on Feb. 2, 2009, and 2009-295700, filed on Dec. 25, 2009 in the Japan Patent Office, which are hereby incorporated by reference herein in their entirety.

BACKGROUND OF THE INVENTION

1. Field of the Invention

The present invention relates to a multi-nozzle inkjet recording apparatus capable of high-speed printing.

2. Description of the Background Art

Inkjet printing has come to be widely used in digitally controlled printing apparatuses due to certain advantages, such as, for example, reduced shock, low noise, and system simplicity. In light of the advantages of the inkjet printing method, many types of inkjet recording apparatuses have been developed and are now commercially available for various purposes, ranging from home use to office use and business use.

The inkjet printing used in color image printing apparatus employs two types of jetting technologies: drop-on demand (DOD) type and continuous inkjet type. In both jetting technologies, a plurality of color inks may be used for forming color images, in which ink of each color is supplied to a print head through separate ink supply paths. The print head includes nozzles from which ink droplets are selectively jetted, and the jetted ink droplets strike a recording medium to form an image thereon. In both cases, a separate ink supply system must be provided for each color of ink used for image forming operations such as printing. Typically, subtractive colors (i.e., cyan, yellow, magenta) are used because these three primary colors can be combined to generate several million recognizable colors.

In inkjet printing using the DOD technique described above, a pressure generating actuator such as a piezoelectric element, or a heating member such as heater, is employed to generate ink droplets directed onto a recording medium. Examples of such methods are described in U.S. Pat. Nos. 3,683,212, 3,747,120, 3,946,398, and 4,723,129. A method of using the heating member, which may be referred to as a thermal inkjet method or bubble jet (registered trademark), is one in which gas is heated to expand and form bubbles of ink that form ink droplets. By activating a piezoelectric actuator or a heater selectively, the ink droplets can be formed and jetted from the print head. The jetted ink droplets travel or fly through a space between the print head and a recording medium and strike the recording medium. An image can be formed on the recording medium by changing a relative position of the print head and the recording medium and controlling the pattern of ejected ink droplets.

By contrast, in continuous inkjet printing, a continuous stream composed of ink droplets is generated by using a pressurized ink supply. A conventional continuous inkjet recording apparatus may use an electrostatic charging device as described in U.S. Pat. No. 3,373,437 to generate a continuous stream of ink droplets. The electrostatic charging device may be disposed at a position near to a leading edge of a filament-like column of ink, in which ink droplets are formed by separating ink from the leading edge of the ink column, and the separated ink droplet is charged by the electrostatic charging device, and then guided to a given position or in a given direction using a deflection electrode having a large potential difference. When no image forming operation such as printing is being performed, ink droplets may be deflected into and recovered by an ink catching unit (e.g., gutter), and such recovered ink may be re-used or discarded. An image forming operation, when it is performed, may be conducted as follows: In one case, when an image forming operation such as printing is performed, ink droplets, which are not deflected, are directed onto a recording medium; alternatively, deflected ink droplets may be directed onto a recording medium while un-deflected ink droplets are collected or recovered by an ink catching unit.

Such continuous inkjet recording apparatuses using an electrostatic charging/deflection mechanism can perform an image forming operation faster and provide better quality images than a drop-on demand (DOD) type apparatus. However, the electrostatic charging/deflection mechanism generally costs more to manufacture and tends to malfunction more often.

In light of such situation, another type of continuous inkjet recording apparatus or system has been proposed as described in U.S. Pat. No. 7,413,293, for example. In such system, a weak heat pulse is applied to an ink column jetted from a nozzle cyclically or periodically using a heater to form separated ink droplets, which are ink droplets separated from the ink column. As such, ink droplets can be formed at a given position distanced from the nozzle by applying a heat pulse at a given timing. The ink droplets can be further categorized as deflected ink droplets and un-deflected ink droplets (or straightforward ink droplets). Both the deflected ink droplets and un-deflected ink droplets can be formed by changing the pattern in which the heat pulses are applied to the ink droplets at a position near to a nozzle exit using the heater. For example, heat pulses may be applied to the ink asymmetrically.

Then, in one configuration, when the deflected ink droplets are traveling in one direction, a flow of gas in a given direction causes the deflected ink droplets to change direction. The deflected ink droplets may be caught by a recovery unit while the un-deflected ink droplets strike a recording medium to form an image thereon.

Conversely, in another configuration, when the un-deflected ink droplets are traveling in one direction, a flow of gas in a given direction causes the un-deflected ink droplets change direction. In this case, the un-deflected ink droplets are caught by a recovery unit while the deflected ink droplets strike a recording medium to form an image thereon.

Such continuous inkjet recording apparatuses using a gas flow do not need to use a conventional electrostatic charging/deflection mechanism, and thereby can enhance ink droplet control. Further, because the electrostatic charging/deflection mechanism can be omitted, a nozzle arrangement density in the continuous inkjet recording apparatus can be increased to, for example, 600 to 2400 dots per inch (dpi). Accordingly, the inkjet head can be provided with more nozzles to match the entire width of the recording medium. Such multi-nozzle inkjet head may be fixed at a given position, and the recording medium may be transported in one direction under the inkjet head for high-speed printing, for example.

However, such an apparatus or system has not been examined extensively for its reliable performance such as stable ink droplet formation, ink jetting, and ink travel because of its employment of the multi-nozzle ink jetting having a greater number of nozzles.

SUMMARY

In one aspect of the present invention, a continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, is devised. The multi-nozzle inkjet head includes a liquid chamber, an ink nozzle plate, a heating unit, a gas flow applicator, a cap, and a gutter unit. The liquid chamber supplies pressurized ink to the ink jetting nozzles. The ink nozzle plate, attached to the liquid chamber, includes the plurality of ink jetting nozzles arranged in a given direction with a given arrangement density to jet the pressurized ink from the liquid chamber. The heating unit including a heater having a film structure is disposed in close proximity to each of the plurality of the ink jetting nozzles. The ink jetting nozzles and the heating unit are integrated as a multiple-ink-nozzle plate. The heating unit stimulates the pressurized ink at an exit opening of each of the ink jetting nozzles to separate ink droplets from a leading edge of the ink column jetted from each of the ink jetting nozzles. The separated ink droplets are flying in a given direction. The gas flow applicator is disposed adjacently to the liquid chamber to apply a gas flow to the flying ink droplets from a given direction to a flying direction of the flying ink droplets. The gas flow applicator includes an opening to jet the gas flow. The cap shields an area of the gas flow from an ambient atmosphere space existing around a transporting and image forming area for the recording medium. The gutter unit is disposed between the area of the gas flow and the transporting area of the recording medium to catch ink droplets that change the flying direction with an application of the gas flow to the flying ink droplets. Ink droplets not caught by the gutter unit are directed onto the recording medium to form an image on the recording medium.

In another aspect of the present invention, a continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, is devised. The multi-nozzle inkjet head includes a liquid chamber, an ink nozzle plate, a heating unit, means for applying, means for shielding, and means for guttering. The liquid chamber supplies pressurized ink to the ink jetting nozzles. The ink nozzle plate, attached to the liquid chamber, includes the plurality of ink jetting nozzles arranged in a given direction with a given arrangement density to jet the pressurized ink from the liquid chamber. The heating unit including a heater having a film structure is disposed in close proximity to each of the plurality of the ink jetting nozzles. The ink jetting nozzles and the heating unit are integrated as a multiple-ink-nozzle plate. The heating unit stimulates the pressurized ink at an exit opening of each of the ink jetting nozzles to separate ink droplets from a leading edge of the ink column jetted from each of the ink jetting nozzles. The separated ink droplets are flying in a given direction. The means for applying applies a gas flow to the flying ink droplets from a given direction to a flying direction of the flying ink droplets. The means for applying the gas flow includes an opening to jet the gas flow. The means for shielding shields an area of the gas flow from an ambient atmosphere space existing around a transporting and image forming area for the recording medium. The means for guttering, disposed between the area of the gas flow and the transporting area of the recording medium, catches ink droplets that change the flying direction with an application of the gas flow to the flying ink droplets. Ink droplets not caught by the means for guttering are directed onto the recording medium to form an image on the recording medium.

In another aspect of the present invention, a method of controlling a continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, is devised. The multi-nozzle inkjet head includes a liquid chamber, an ink nozzle plate, and a heating unit. The liquid chamber supplies pressurized ink to the ink jetting nozzles. The ink nozzle plate, attached to the liquid chamber, includes the plurality of ink jetting nozzles arranged in a given direction with a given arrangement density to jet the pressurized ink from the liquid chamber. The heating unit including a heater having a film structure is disposed in close proximity to each of the plurality of the ink jetting nozzles. The ink jetting nozzles and the heating unit are integrated as a multiple-ink-nozzle plate. The method includes stimulating, applying, shielding, and catching. The stimulating stimulates the pressurized ink at an exit opening of each of the ink jetting nozzles to separate ink droplets from a leading edge of the ink column jetted from each of the ink jetting nozzles. The separated ink droplets are flying in a given direction. The applying applies a gas flow to the flying ink droplets from a given direction to a flying direction of the flying ink droplets using a gas flow applicator. The gas flow applicator includes an opening to jet the gas flow. The shielding shields an area of the gas flow, using a cap, from an ambient atmosphere space existing around a transporting and image forming area for the recording medium. The catching catches ink droplets, using a gutter unit, that change flying direction with application of the gas flow. Ink droplets not caught by the gutter unit are directed onto the recording medium to form an image on the recording medium.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

DETAILED DESCRIPTION OF EXEMPLARY EMBODIMENTS

Figure 1:
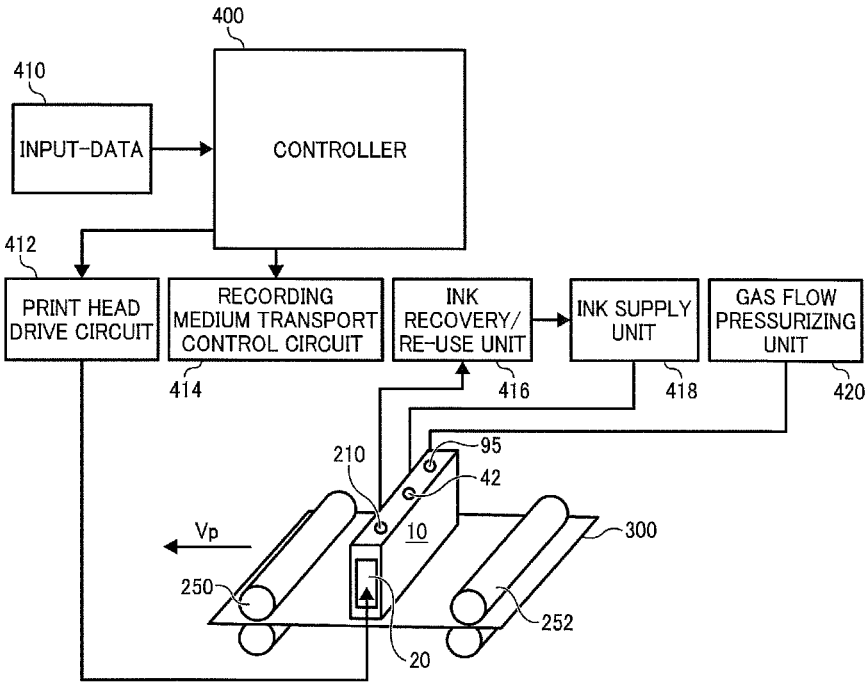
FIG. 1 illustrates a schematic configuration of a continuous multi-nozzle inkjet recording apparatus according to an example embodiment and its block diagram.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, Operations, elements, and/or components, but do not preclude the presence or addition of one or more other features, integers, steps, Operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that operate in a similar manner.

It is to be noted that a sheet includes, but is not limited to, a medium made of material such as paper, string, fiber, cloth, leather, metal, plastic, glass, timber, and ceramic, for example. Further, the term "image formation" used herein in this patent specification refers to providing, recording, printing, or imaging an image, a letter, a figure, or a pattern to a sheet or a plate. Moreover, the term "ink" used herein is not limited to recording liquid or ink but includes anything jetted in fluid form and capable of forming an image. Hereinafter, the recording liquid is referred to as ink solely for simplicity of description, and "ink" means any kind of liquid that can be dispensed from a jetting head, including but not limited to ink used for inkjet printers, deoxyribonucleic acid (DNA) samples, resist pattern material, patterning material, or the like.

Referring now to the drawings, a description is now given to a continuous multi-nozzle inkjet recording apparatus according to an exemplary embodiment. FIG. 1 illustrates an example configuration of a continuous multi-nozzle inkjet recording apparatus according to an example embodiment. As shown in FIG. 1, the continuous multi-nozzle inkjet recording apparatus or system may include a continuous inkjet head 10, a post-print transport roller 250, a pre-print transport roller 250, a recording medium 300, a controller 400, an input-data 410, a print head drive circuit 412, a recording medium transport control circuit 414, an ink recovery/re-use unit 416, an ink supply unit 418, a gas flow pressurizing unit 420, for example.

The continuous inkjet head 10 may include a number of nozzles arranged in a given length, which can be matched to an image-recording width on the recording medium 300 so that an image can be formed on the recording medium 300 in its image-recording width entirely. The continuous inkjet head 10 may be fixed at a given position, and the recording medium 300 is transported in one direction shown by an arrow Vp to perform a high speed printing.

The continuous inkjet recording apparatus can generate ink droplets with a high frequency compared to a drop-on demand (DOD) type inkjet recording apparatus. Accordingly, the continuous inkjet recording apparatus can perform a high-speed printing, a high-speed throughput, and a large-volume printing. Such desired features of the continuous inkjet recording apparatus can be achieved and enhanced by fixing the continuous inkjet head 10 and transporting the recording medium 300. Such high frequency of ink-droplet formation can be effectively utilized by using a rolled recording medium (e.g., rolled sheet, rolled paper) as the recording medium 300 instead of cut recording medium (e.g., cut sheet) as the recording medium 300. When the cut recording medium is used, the recording medium is transported one by one. On one hand, when the rolled recording medium is used, the recording medium can be fed continuously by rotating the rolled recording medium while image forming operations are conducted, by which the recording medium can be transported with a high speed, and thereby a high speed printing, a high speed throughput, and a large-volume printing can be preferably achieved.

Such configuration that fixes the continuous inkjet head 10 and transports a recording medium in one direction for conducting an image forming operation can achieve enhanced image forming productivity. For example, when the continuous inkjet head 10 has a nozzle density of "600 dpi (dot per inch) to 2400 dpi" matched to an image-dot density of "600 dpi to 2400 dpi," the continuous inkjet head 10 can conduct an image forming operation by producing 50 sheets or so per minute as a minimum productivity, or by producing 3000 sheets or so per minute as a maximum productivity, wherein the sheet numbers are A4-size converted sheet number. For example, when a drop-on-demand (such as thermal inkjet method) is employed for an inkjet head, an image forming operation producing 50 to 200 sheets or so per minute can be conducted, and when a continuous inkjet head is employed for inkjet head, an image forming operation producing 300 to 3000 sheets or so per minute can be conducted, which is about ten times higher than the drop-on-demand method.

The A4-size converted sheet number means a total number of printed sheets of A4-size that is formed on a rolled sheet, which is fed continuously during an image forming operation. Accordingly, the A4-size converted sheet number does not mean that 3000 of cut sheets having A4-size is obtained per one minute. As such, image forming productivity expressed by the A4-size converted sheet number means that images corresponding to the image forming productivity can be formed on a rolled recording medium. Accordingly, when including a cutting process of rolled recording medium having printed images thereon, a total image forming productivity per one minute becomes smaller than image forming productivity expressed by the A4-size converted sheet number. As such, the recording medium 300 of rolled recording medium is continuously transported with a high speed when images are formed on the recording medium 300, and then the recording medium 300 is cut into cut-sheet one by one so that a required number of cut-sheets can be prepared for a given use.

Another configuration can be used for a continuous inkjet recording apparatus. For example, a serial type printer can be used for a continuous inkjet recording apparatus, in which a print head moves over a recording medium using a carriage mechanism.

Further, the continuous inkjet recording apparatus according to an example embodiment can be combined with other printing method such as an "off-set printing method", which may be employed for printing a greater size image on a greater size sheet. The offset printing method may be a letterpress printing method, a surface printing method, a plate printing method, and a screen-printing method, for example. In such combination, an off-set printing apparatus may be used for printing one image on a sheet, and the continuous inkjet recording apparatus may be used for printing another image on the same sheet.

For example, commercially printed materials (e.g., direct mail printing), which may be sent to a number of customers, may be printed using a combination of an off-set printing apparatus and a continuous inkjet recording apparatus, which may be called as hybrid printing system. Such direct mail may have image information (e.g., product, price), which is common for all customers. Such common information may be printed using the conventional offset printing method (e.g., letterpress printing method, surface printing method, plate printing method, screen printing method). Further, such direct mail needs to be printed with customer-specific information (e.g., customer address, customer name). Such customer-specific information may be printed using the continuous inkjet recording apparatus.

When such combined printing system is employed for a given use, the offset printing apparatus and the continuous inkjet recording apparatus may preferably use a common transport unit to transport a recording medium in the combined printing system. Such common transport unit may be provided with a speed sensor to detect a transport speed of recording medium transported in the combined printing system. Typically, the continuous inkjet recording apparatus is connected after the offset printing apparatus, which means a printing operation is firstly conducted by the offset printing apparatus, and then another printing operation is conducted by the continuous inkjet recording apparatus. In such combined printing system, a transport speed of recording medium transported in the offset printing apparatus is detected by the speed sensor. Then, based on the detected transport speed of recording medium, a controller adjusts an ink-droplet jetting timing in the continuous inkjet recording apparatus so that an image can be printed on a desired position on the recording medium.

Figure 2:
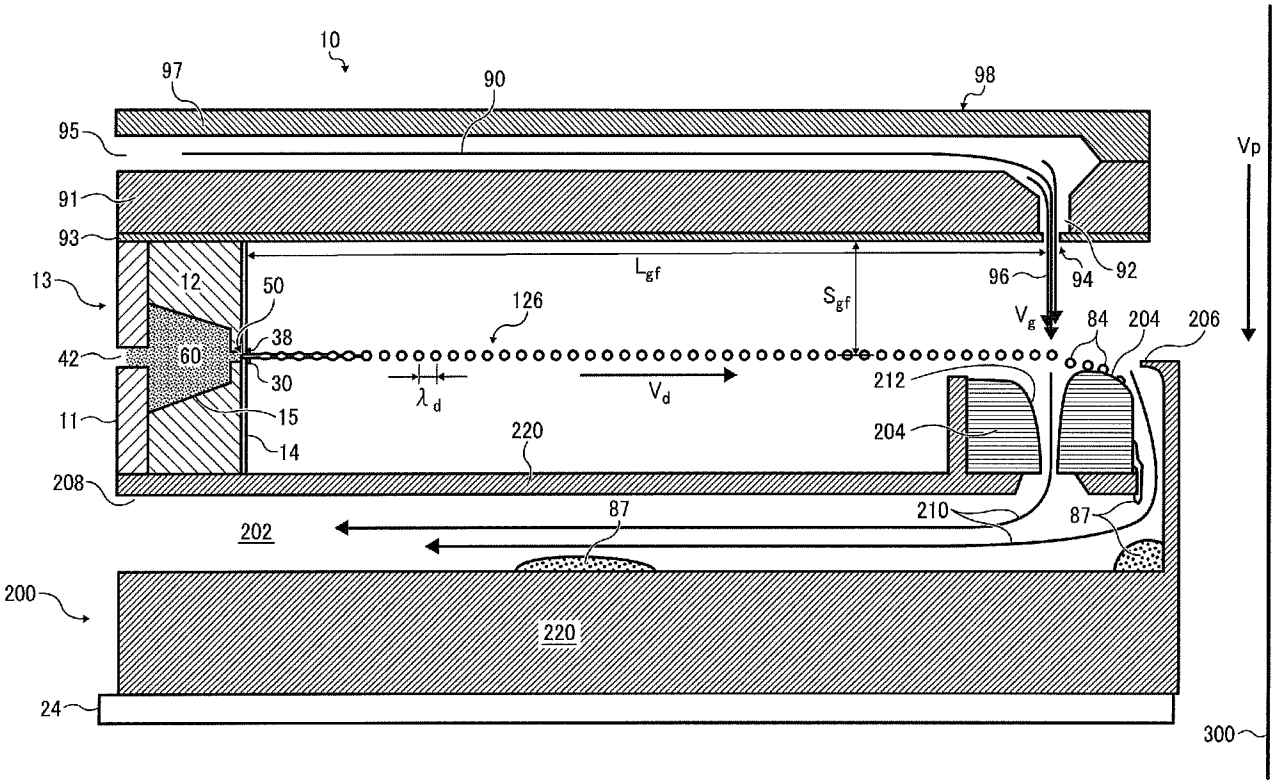
FIG. 2 illustrates a cross-sectional view of a continuous inkjet print head described in conventional art, in which a mechanism of image forming operation using ink droplet is depicted.

FIG. 2 illustrates a cross-sectional view of the continuous inkjet print head 10, which faces the recording medium 300. FIG. 2 shows a mechanical configuration of a continuous multi-nozzle inkjet recording apparatus. As illustrated in FIG. 2, the continuous inkjet print head 10 may include a print head back plate 11, a print head chamber manifold 12, an ink nozzle plate 14, a print head support member 24, an ink supply port 42, an ink jetting nozzle 50, a liquid chamber 15, pressurized ink 60, a recovered ink 87, a pressurized gas flow 90, a gas-flow supply manifold 91, a gas supply port 92, a gas nozzle plate 93, a gas jetting nozzle 94, a pressurized gas-flow inlet 95, a gas flow 96, a gas-flow supply manifold cover 97, a gas-flow supply unit 98, ink droplets 126, an ink recovery unit 200, an ink recovery route 202, a porous member 204, a gutter 206, an ink recovery/suction unit 208 (may be referred to as a gutter unit), a suctioned airflow 210, an ink/gasflow suction slot 212, an ink suction manifold 220, for example. The ink jetting nozzle 50 includes an exit opening, through which the pressurized ink 60 is jetted from the liquid chamber 15. The gas-flow supply manifold 91, gas supply port 92, gas nozzle plate 93, gas jetting nozzle 94, pressurized gas-flow inlet 95, gas-flow supply manifold cover 97, and gas-flow supply unit 98 may be collectively referred to a gas flow applicator. The ink droplets 126 are separated from an ink column and then fly in a given direction. The gas flow applicator may include an opening to jet the gas flow 96. Such opening of the gas flow applicator may be set as an exit opening of the gas jetting nozzle 94, for example. FIG. 2 illustrates a cross-sectional view of the continuous inkjet print head 10. Accordingly, the ink jetting nozzle 50 is disposed for a plurality of numbers in a given direction in the continuous inkjet print head 10.

In such configuration, the pressurized ink 60 is introduced into the liquid chamber 15 of the print head chamber manifold 12 through the ink supply port 42. Then the pressurized ink 60 is jetted from the ink jetting nozzle 50, and then broken into ink droplets constantly and continuously by using a device such as a heating unit to be described later, and the ink droplets 126 fly with a flying speed of Vd. When the ink droplets 126 fly into a straightforward direction as shown in FIG. 2, the ink droplets 126 impact the recording medium 300 to form an image on the recording medium 300. The recording medium 300 may be transported in a direction shown by an arrow with a speed of Vp. However, under a given circumstance, the recording medium 300 may be transported in an opposite direction.

On one hand, some ink droplets may not travel or fly in a straightforward direction, but may deflect from the straightforward direction with an effect of a device such as a heating unit to be described later. For example, some ink droplets are deflected to a given direction in FIG. 2 with an effect of a device such as a heating unit to be described later, and then the deflected ink droplets are further deflected to a downward direction with an effect of the gas flow 96 jetting from the gas jetting nozzle 94 with a speed Vg. The deflected ink droplets may be caught, captured, or recovered by the ink/gasflow suction slot 212, or the gutter 206 disposed after the ink/gasflow suction slot 212, and then the caught or captured ink droplets may accumulate as the recovered ink 87 (see FIG. 2). In example embodiments, "catch," "capture", and "recover" may be used inter-changeably.

As such, the deflected ink droplets not used for image forming, changes its flying direction with an effect of the gas flow 96 jetted from the gas jetting nozzle 94 with the speed Vg, and then the deflected ink droplets moves to the ink/gasflow suction slot 212 or the gutter 206 disposed after the ink/gasflow suction slot 212. Further, the deflected ink droplets may be effectively caught or captured in the ink recovery/suction unit 208 (used as gutter unit) by flowing the suctioned airflow 210. In such configuration, ink droplets moving in a straightforward direction are used for image forming, and deflected ink droplets are caught or captured. Such image forming/recovery configuration is just one pattern employed for an example embodiment of continuous multi-nozzle ink jetting, but other configuration patterns for image forming/recovery can be employed, which are to be described later.

The ink droplets can be jetted constantly and continuously under a given condition. For example, the pressurized ink 60, jetted from the ink jetting nozzle 50 with a pressure of 0.2 MPa to 1 Mpa, may form ink droplets flying with a speed of Vd=10 m/s to 20 m/s. Such pressure and speed value may be set by setting a given frequency for heat pulse, to be described later, and a diameter D of one droplet of ink. Typically, a relation of $\lambda d/D=4$ to 6 may be set to generate ink droplets having preferable droplet shape constantly and continuously, which may be uniform shape for ink droplets.

Each of the ink jetting nozzles 50 has an exit opening, which may be surrounded by a first heater 30 and a second heater 38, which may be disposed at right and left side of the ink jetting nozzle 50, for example. The heater can be formed by using a thin film forming method, for example. Such first heater 30 and second heater 38 may be referred to as a heating unit. In example embodiments, the heating unit may employ two heaters as above-mentioned, for example, but not limited thereto. Such heating unit may stimulate the pressurized ink at an exit opening of each of the ink jetting nozzles to separate ink droplets from a leading edge of the ink column jetted from each of the ink jetting nozzles.

A plurality of the ink jetting nozzles 50 are arranged in a given direction by setting an given interval between adjacent ink jetting nozzles 50. The interval may be correlated to image-dot density used for image forming. For example, the interval may be set from 42.3 μm to 10.6 μm (corresponding to image-dot density 600 dpi to 2400 dpi), and a nozzle opening size Dd corresponded to such interval may be set to ϕ23 μm to ϕ5 μm. Further, a nozzle depth may be set to 20 μm to 5 μm. The tolerance for such parts may be set to +/−0.2 μm, and the surface roughness of wall of ink jetting nozzle 50 may be set to 0.1 μm or less.

As such, the plurality of ink jetting nozzles 50 may be arranged in a given direction to form a multi-nozzle plate. The multi-nozzle plate can be manufactured using silicon substrate (Si-substrate) and semiconductor processing technology. For example, the Si-substrate is used to form a common ink chamber to multi-nozzles, and semiconductor processing technology such as anisotropic etching, isotropic etching, wet etching, dry etching, or the like may be used.

Further, the above mentioned heaters and address electrodes formed around an exit side of the ink jetting nozzle 50 can be formed using a thin film forming technology using evaporation/sputtering, photolithography, and etching technology, for example. For example, an electrode pattern of heater/Al having thin film structure made of heat generating material such as Ta-nitride, hafnium boronide, or the like may be formed. Further, an ink path and surface of heater/electrode may be coated with a thin film such as for example Si-oxide, Si-nitride, or the like to prevent corrosion of components, which contact ink.

In an example embodiment, when the pressurized ink 60 is jetted as ink column from the ink jetting nozzle 50 without applying a given effect such as heat pulse, a naturally-formed surface wave may be formed on the jetted ink column. Then, the ink column is broken into ink droplets at a break position, wherein the break position is distanced from the ink jetting nozzle 50 for a given length. The ink droplet, separated from the ink column at the break position, may become a non-uniform-shaped ink droplet. As such, the non-uniform-shaped ink droplet may be particles (i.e., ink droplet) formed naturally. Such non-uniform-shaped ink droplet may have non-uniform mass and non-uniform flying speed, which is not preferable for ink jet printing.

In contrast, when the pressurized ink 60 is jetted as the ink column from the ink jetting nozzle 50 by applying heat pulse using the first heater 30 and second heater 38, a controlled surface wave is formed on the ink column. Then, the ink column is broken into ink droplets at a break position, wherein the break position is distanced from the ink jetting nozzle 50 for a given length. The ink droplet, separated from the ink column, may become a uniform-shaped ink droplet. As such, the uniform-shaped ink droplets may be particles (i.e., ink droplet), which can be formed by applying uniform heat pulse from both of the first heater 30 and second heater 38. When the heat energy to be applied to the ink column is differentiated between the first heater 30 and second heater 38, an ink droplet may be unevenly heated (i.e., unsymmetrical heat pattern), by which ink droplet may fly in a deviated direction (i.e., right or left side). In such configuration, the pressurized ink 60 and the heaters 30/38 together may form a separation unit for separating ink droplets constantly and continuously from an ink column. Specifically, ink droplets can be jetted constantly and continuously by jetting the pressurized ink 60 while applying heat energy using the heaters 30/38.

Figure 3A:
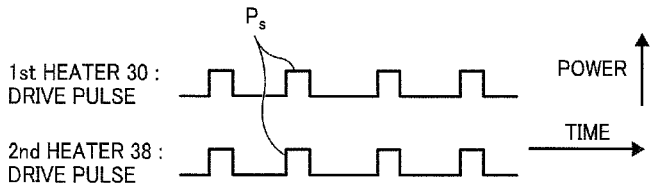
FIGS. 3A, 3B, and 3C show example heat pulse patterns for forming ink droplets such as deflected ink droplet.
Figure 3B:
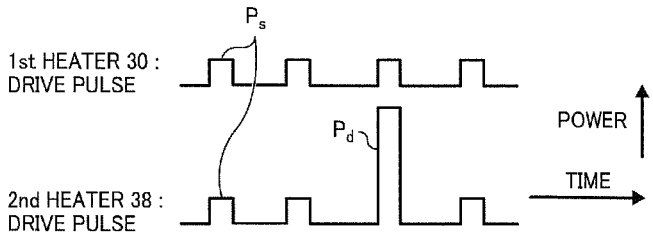
Figure 3C:
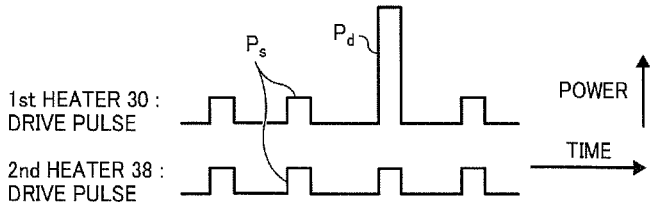

A description is given to heat pulse to be generated by the first heater 30 and second heater 38 with reference to FIGS. 3A, 3B, and 3C. FIGS. 3A, 3B, and 3C show example patterns of drive voltage pulse applied to the first heater 30 and second heater 38 disposed near the ink jetting nozzle 50, in which POWER indicates a drive voltage.

In FIG. 3A, a same drive pulse is applied to both of the first heater 30 and second heater 38 when jetting the ink column from the ink jetting nozzle 50. Accordingly, the ink column jetted from the ink jetting nozzle 50 can maintain its shape in a symmetrical shape along the axis direction of the ink column, and particles (i.e., ink droplets) are also formed in a symmetrical shape. As such, the symmetry of the ink column can be maintained. In such condition, a standing wave may be formed on the surface of the ink column and then the uniform-shaped ink droplet can be formed. Further, such ink column and uniform-shaped ink droplet can travel or fly in a straight-forward direction while maintaining symmetrical shape of the ink column and symmetrical shape of the uniform-shaped ink droplet. In contrast, in case of naturally-formed particles (i.e., ink droplets), the naturally-formed particles may have unsymmetrical shape and may have an unstable condition.

In case of FIG. 3A, such same drive pulse applied to both of the first heater 30 and second heater 38 may have a given frequency such as from 100 kHz to 300 kHz, for example. When the frequency from 100 kHz to 300 kHz is applied, heating energy per one drive pulse may be set to 0.1 μJ to 10 μJ, for example. Using such drive pulse (or heat pulse) having such frequency, a number of ink droplets can be formed. For example, $1\times10^5$ to $3\times10^5$ of ink droplets can be formed per one nozzle and per one second.

In FIG. 3B, the second heater 38 (e.g., right side heater) is applied with a second energy pulse Pd, which is higher than a first energy pulse Ps. With such pulse application, heat energy is applied to ink unsymmetrical manner, by which the ink column and ink droplets are deflected to a side of the first heater 30 (left side heater).

In FIG. 3C, the first heater 30 (e.g., left side heater) is applied with the second energy pulse Pd, which is higher than the first energy pulse Ps. With such pulse application, heat energy is applied to ink unsymmetrical manner, by which the ink column and ink droplets are deflected to a side of the second heater 38 (right side heater). As such, straightforward ink droplets and deflected ink droplet can be selectively formed in an example embodiment.

A description is now given to a process of using the straightforward ink droplet and deflected ink droplet as image forming droplet (dot-forming droplet) and image not-forming droplet (dot-not-forming droplet). In an example embodiment, ink may exist as a plurality of ink droplets. For the sake of the simplicity of expression, in this specification, ink droplet may mean a single droplet or a plurality of droplets.

As above described, when the ink column is jetted from the ink jetting nozzle 50, a heat pulse can be applied to the ink column using the first and second heaters. When a same heat pulse pattern is applied to the ink column from the first and second heaters, straightforward ink droplets can be separated and formed from the leading edge of the ink column. When different heat pulse patterns are applied to the ink column from the first and second heaters, deflected ink droplets can be separated and formed from the leading edge of the ink column.

The ink jetting nozzle 50 and the gas jetting nozzle 94 may have a given positional relationship so that the deflected ink droplet flying in air may enter a flow path of the gas flow 96 jetted from the gas jetting nozzle 94. When the deflected ink droplet enters the flow path of gas flow 96, the deflected ink droplet is deflected to the flow direction of gas flow 96 shown by an arrow Vg shown in FIG. 2, which may be substantially perpendicular to a flying direction of the deflected ink droplet. As such, the gas flow 96 may flow to the ink droplet from a substantially perpendicular direction with respect to a flying direction of ink droplet. Further, the gas flow 96 may flow to the ink droplet from a given direction other than the perpendicular direction and substantially perpendicular direction depending on apparatus designs. Then, the deflected ink droplet further travels to the ink/gasflow suction slot 212 or the gutter 206 disposed after the ink/gasflow suction slot 212 (see FIG. 2), and becomes as image-not-forming droplet (dot-not-forming droplet), and then may be caught or captured as recovered ink. In example embodiments, the ink jetting nozzles 50 are arranged in a given direction with a given nozzle density to form a multi-nozzle inkjet head, and the gas jetting nozzles 94 are arranged in a given direction with a given nozzle density, in which the nozzle density of ink jetting nozzles 50 and the nozzle density of gas jetting nozzles 94 may be matched each other, but such nozzle density relation is not limited to such same nozzle density.

On one hand, the straightforward ink droplets may travel in a straightforward direction, which may not enter the flow path of the gas flow 96. Accordingly, the straightforward ink droplets can travel in a straightforward direction without receiving an effect of the gas flow 96. Then, the straightforward ink droplets may fly over the gutter 206 (see FIG. 2) and impact the recording medium 300, by which an image can be formed on the recording medium 300. As such, the straightforward ink droplets may be used as image-forming droplet (dot-forming droplet).

Another example flow pattern of gas flow 96 jetted from the gas jetting nozzle 94 is described. In case of the above explained case, a ratio of the ink jetting nozzles 50 and the gas jetting nozzles 94 is set to one-to-one (1 on 1). In this another example case, a ratio of the ink jetting nozzles 50 and the gas jetting nozzles 94 is set to two-to-one (2 on 1), in which one gas jetting nozzle 94 is used for two ink jetting nozzles 50, and the gas jetting nozzle 94 may be disposed between the two ink jetting nozzles 50.

As above described, in example embodiments, a symmetrical shape of the ink column can be changed to an asymmetrical shape by applying a given heat pulse using the first heater and second heaters, by which the ink column and ink droplets can be deflected. For example, assume a case that two ink jetting nozzles 50 are adjacently provided and one gas jetting nozzle 94 is provided between the two ink jetting nozzles 50. In such a configuration, the ink column and ink droplets jetted from one ink jetting nozzle 50 can be deflected toward the second heater (e.g., right side heater), and the ink column and ink droplets jetted from other ink jetting nozzle 50 can be deflected toward the first heater (e.g., left side heater). Then, the deflected ink droplets coming from the one ink jetting nozzle 50 and other ink jetting nozzle 50 may pass through the gas flow 96, jetted from the gas jetting nozzle 94. As such, one gas flow 96 jetted from one gas jetting nozzle 94 can be used to deflect ink droplets coming from both of the one ink jetting nozzle 50 and other ink jetting nozzle 50, and then the ink droplets can be guided to the gutter 206, and caught or captured as recovered ink. As such, the straightforward ink droplet may be used for image forming while deflected ink droplet may be caught or captured as recovered ink.

Another example for a flow pattern of gas flow 96 is described. In this another case, a ratio of the ink jetting nozzles 50 and the gas jetting nozzles 94 is set to one-to-one (1 on 1), and the gas jetting nozzle 94 is disposed for each of ink jetting nozzles 50. Specifically, an ink droplets stream traveling or flying in a straightforward direction pass through a position right under the gas jetting nozzle 94.

Accordingly, the straightforward ink droplet may change its flying direction to the gutter 216 with an effect of the gas flow 96, and caught or captured as recovered ink. In contrast, ink droplets deflected with an application of heat pulse fly in space without receiving an effect of the gas flow 96, may pass over the gutter 206 and impact the recording medium 300 to form an image thereon, in which deflected ink droplets may be used as image-forming droplet (dot-forming droplet).

In the above-described three example embodiments, which may be related to patters shown in FIGS. 3A, 3B, and 3C, a pulse width of drive pulse shown in FIGS. 3A, 3B, and 3C is set to a given constant value, by which the uniform-shaped ink droplet may be formed by applying a given pattern of heat pulse, in which the uniform-shaped ink droplet may be used as the image-forming droplet (dot-forming droplet), or caught or captured by the gutter 206.

Different from patterns shown in FIGS. 3A, 3B, and 3C, another example embodiment can be devised. Specifically, a wave pattern of drive pulse applied to the heater shown in FIGS. 3A, 3B, and 3C can be changed to another wave pattern in view of image information to be printed on a sheet. For example, a pulse width of drive pulse and/or pulse interval of drive pulse can be changed or adjusted in another pattern in view of image information to be printed on a sheet. When such condition of drive pulse is changed, ink mass (or ink amount) of ink droplet to be broken from the ink column can be changed to given values, by which a plurality of ink droplets having different sizes (or mass) can be formed. Such ink droplets having different sizes (or mass) may come to a position that the gas flow 96 are flowing, at which ink droplets can be deflected and may be used for image forming. Accordingly, size of jetted ink droplets may variably set from a smaller mass ink droplet to a greater mass ink droplet. Specifically, a smaller mass ink droplet may be more likely to be effected by a gas flow and may be deflected greatly: a greater mass ink droplet may be less likely to be effected by a gas flow, and may substantially travel or fly in a straightforward direction without greater deflection. Under such condition, the small ink droplets may be deflected and caught or captured by the gutter 216 while the large ink droplets may impact onto or strike the recording medium 300 to form an image thereon.

Although the greater mass ink droplet may substantially travel or fly in a straightforward direction, but the ink column may be affected by a gas flow for some degree, by which the ink column may be deflected in a microscopic level. In such condition, the ink column may not be deflected by applying heat pulse, but the ink column may be deflected with an effect of gas flow in a microscopic level. As similar to the above-described three example patterns shown in FIGS. 3A, 3B, and 3C, a gas flow can be jetted from the gas jetting nozzle 94 in view of an arrangement pattern of the ink jetting nozzle 50.

In such condition, a deflection distance of ink droplets can be changed depending on a mass size of ink droplets because ink droplets having different mass may be deflected in a different manner when the ink droplets enter a gas flow. Accordingly, a deflection distance of ink droplet can be controlled using a same gas flow for any ink droplets in view of mass size of ink droplets, by which ink droplets having different mass (or size) can be selectively used. For example, a larger ink droplet may substantially travel or fly in a straightforward direction, and impact or strike a sheet to form an image thereon, while a smaller ink droplet may be deflected significantly, and then caught or captured by the gutter 216. Although a plurality of gas jetting nozzles 94 are provided in the above described embodiment, one gas jetting nozzle 94 may be sufficient to control inkjet droplet streams. For example, one slit-shaped opening port may be provided as one gas jetting nozzle 94, and then common gas flow may be jetted to each of the inkjet droplet streams as air curtain flow.

The above-described four example embodiments can be preferably employed for the continuous multi-nozzle inkjet recording apparatus.

A description is now given to a configuration of multi-nozzle inkjet head. In example embodiments, image-forming droplet (dot-forming droplet) and image-not-forming droplet (dot-not-forming droplet or caught or captured ink droplet) may be mainly determined by a heating condition of the first and second heaters and the gas flow 96. The heating condition of the first and second heaters may cause to change a symmetrical shape of the ink column to asymmetrical shape. The gas flow 96 effects a flying direction of ink droplets, and may guide the ink droplets into a direction of the gutter 206. The gas flow 96 may need to be flown with higher precision so that the gas flow 96 can be effectively blown to the image-not-forming droplet (dot-not-forming droplet) and to guide the image-not-forming droplets into a direction of the gutter 206 while not interfering other flying ink droplets to be used for image forming.

The gas jetting nozzle 94 used in the example embodiments may employ a nozzle, which has a similar size of the ink jetting nozzle 50 used for jetting ink, and similar precision for manufacturing a nozzle. As such, the gas jetting nozzle 94 can be manufactured as a multi-nozzle plate as similar to a multi-nozzle plate used for the ink jetting nozzle 50 using Si-substrate, for example. The size of gas jetting nozzle 94 may have a given size corresponding to the above-mentioned image-dot density of 600 dpi to 2400 dpi, for example, in which the nozzle opening size Dg may be 925 μm to 98 μm, and the nozzle depth may be set to 30 μm to 5 μm. Such a plurality of gas jetting nozzles 94 may be arranged in a given direction parallel to an array including a plurality of the ink jetting nozzles 50, for example.

When ink droplets having different mass are formed and a common gas flow is blown as air curtain from a common slit opening, set for the gas jetting nozzles 94, such common opening may need to be manufactured with a given precision. For example, a short side of the common slit opening may be manufactured with a size from 50 μm to 100 μm with a tolerance of +/−1 μm (50 μm to 100 μm+/−1 μm), which may not be so severe compared to the tolerance set for the gas jetting nozzle 94. Further, the surface roughness of wall of common slit opening may be set to 0.1 μm or less, which is same as the gas jetting nozzle 94. Further, the common slit opening may need to be free from foreign particles (e.g., particle adhesion).

Furthermore, the gas jetting nozzle 94 formed in a higher precision shape needs to flow gas effectively and reliably to image-not-forming droplet (dot-not-forming droplet). In case of common slit opening, an air curtain flow needs to be flown without flow fluctuation of gas flow.

As above described, ink-droplet-formation frequency is high in the continuous inkjet recording apparatus, by which high speed printing, high speed throughput, large-volume printing can be devised. Accordingly, a recording medium such as paper, or the like is transported at a high speed. In such environment, paper powders may be constantly floating in air. Such paper powders may be tiny particles included in paper such as for example cellulose fibers included in paper, and coating agent (e.g., calcium carbonate) of paper. Further, in addition to such paper powder (e.g., cellulose, tiny particles) of paper, fiber-like foreign materials and/or particle-like foreign materials may also be floating in air. Such tiny particles and foreign materials may adhere around the gas jetting nozzle 94, by which jetting of gas flow may be disturbed. In case of common slit opening, the gas flow speed of air curtain flow may fluctuate locally when foreign materials adhere.

Further, in a space around the gas jetting nozzle 94, microscopic ink droplets are constantly flying, by which water component in ink may increase humidity around the gas jetting nozzle 94. Because of such high humidity environment, foreign materials may be more likely to aggregate, by which tiny particles and/or foreign materials may be more likely to adhere around the gas jetting nozzle 94 or common slit opening.

Figure 4:
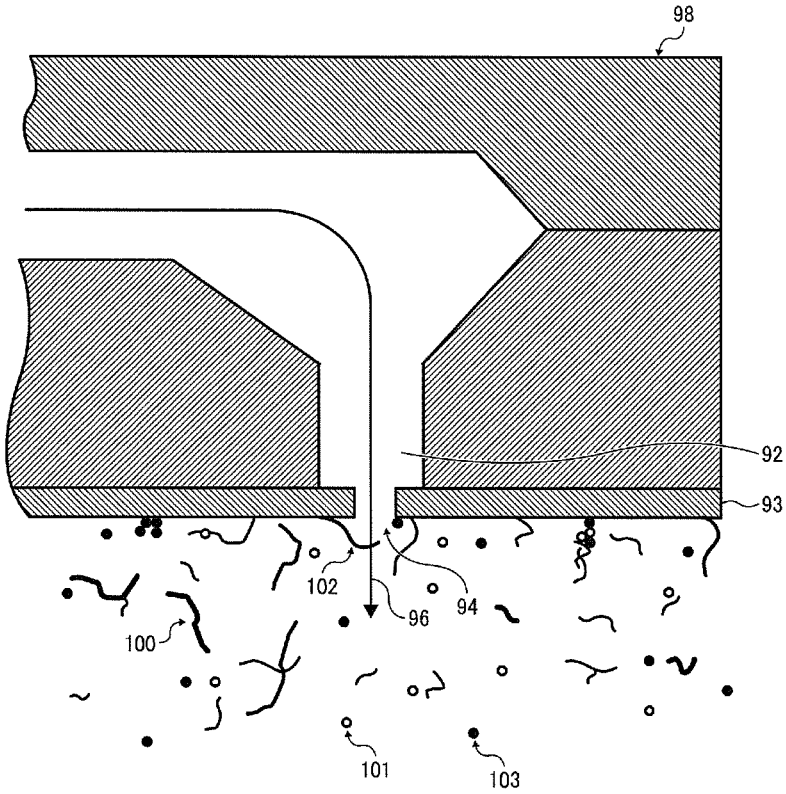
FIG. 4 illustrates an expanded view of a gas jetting nozzle in the continuous inkjet print head, in which foreign materials are floating near the gas jetting nozzle.

A description is given to an environment around the gas jetting nozzle 94 (see FIG. 2) with reference to FIG. 4. As shown in FIG. 4, the gas jetting nozzle 94 or common slit opening may be surrounded by a cellulose 100, a tiny particle 101, a fiber-like foreign material 102, and a particle-like foreign material 103, for example. Such particles may be floating alone or in aggregation with other particles, or may adhere around the gas jetting nozzle 94.

When foreign materials adhere around the gas jetting nozzle 94 and disturb jetting of gas flow 96, the gas flow 96 may not correctly blow ink droplets, by which image-not-forming droplet (dot-not-forming droplet) may not be caught or captured as recovered ink. In such a case, such image-not-forming droplet (dot-not-forming droplet) may impact and adhere on the recording medium 300, by which image quality may degrade. When foreign materials adhere around the common slit opening, the gas flow speed of air curtain flow may fluctuate locally, by which small ink droplets may not be caught or captured, and such un-caught or un-captured small ink droplets may impact and adhere on the recording medium 300, by which image quality may degrade.

In another case, foreign materials may disturb gas flow direction of the gas flow 96. Such flow-direction-disturbed gas flow may deviate a flying direction of image-forming droplet from a correct direction, by which image quality may degrade. In another case, foreign materials may clog the gas jetting nozzle 94 completely, by which the gas flow 96 cannot be jetted, by which image quality may degrade severely.

The gas jetting nozzle 94 may not be adhered with foreign materials and may be not clogged by foreign materials if the gas flow 96 is continuously jetted from the gas jetting nozzle 94. However, a gas flow jetting is stopped when an image forming operation such as printing operation is stopped. Under such condition, foreign materials may adhere on or around the gas jetting nozzle 94 easily.

In view of such foreign material adhesion to the gas jetting nozzle 94, in example embodiments, an area of gas flow jettable from the gas jetting nozzle 94 may be shielded from an ambient atmosphere space existing around a transportation area set for recording medium and an image forming area set for recording medium during a stop of image forming operation such as printing operation by using a cap, which may be referred to as a gas-jetting nozzle cap 110. As such, the opening of the gas flow applicator can be shielded from the ambient atmosphere space existing around the transportation and image forming area of the recording medium 300. As such, the ambient atmosphere space may exist around the opening of gas jetting nozzle 94 and further exist from the opening of the gas jetting nozzle 94 to the transporting and image forming area for the recording medium. Further, when the common slit opening is provided as above described, similar type of problem related to foreign material adhesion may occur. Accordingly, the gas-jetting nozzle cap 110 to be described can be similarly employed for the common slit opening. As described later, the gas-jetting nozzle cap 110 may exert a preferable effect.

Figure 5:
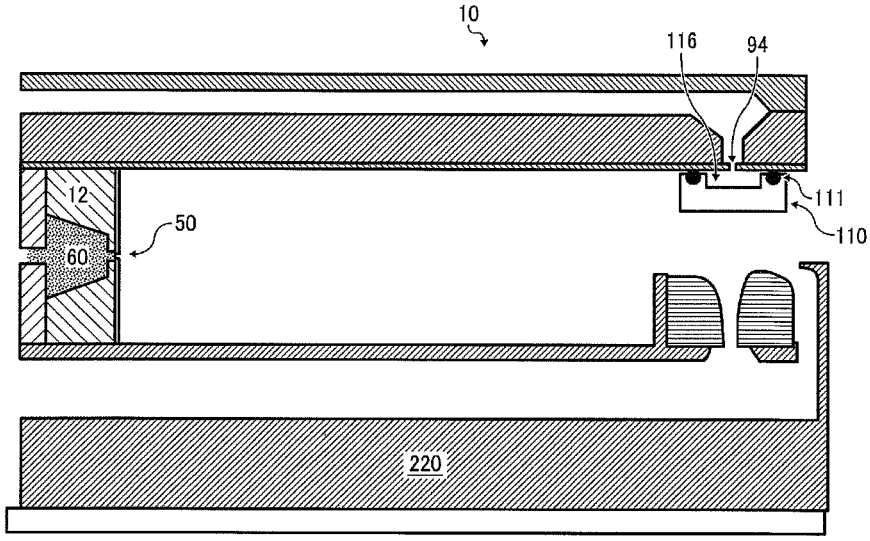
FIG. 5 illustrates a cross-sectional view of the continuous inkjet print head, in which the gas-jetting nozzle cap is provided to shield the gas jetting nozzle from atmosphere when no image forming operation is conducted.

FIG. 5 illustrates one example embodiment of a capping configuration for a plurality of gas jetting nozzles 94 provided in a given direction, in which the gas jetting nozzles 94 can be capped by the gas-jetting nozzle cap 110. The gas-jetting nozzle cap 110 is provided with an elastic sealing member 111 disposed along the peripheral of a groove portion 116 of the gas-jetting nozzle cap 110. The groove portion 116 may have a given length corresponded to a total length of gas jetting nozzles 94 provided in the given direction. The elastic sealing member 111 may be made of fluoro plastic (e.g., fluoro rubber) having a higher chemical resistance, and the elastic sealing member 111 may be shaped in an O-ring shape. Accordingly, with a combination of the elastic sealing member 111, the gas-jetting nozzle cap 110 can shield the plurality of gas jetting nozzles 94 more effectively from an ambient atmosphere space existing around a transportation set for recording medium and image forming area set for recording medium, in which cellulose, tiny particles, fiber-like foreign materials, and particle-like foreign materials may be floating, for example.

Figure 6:
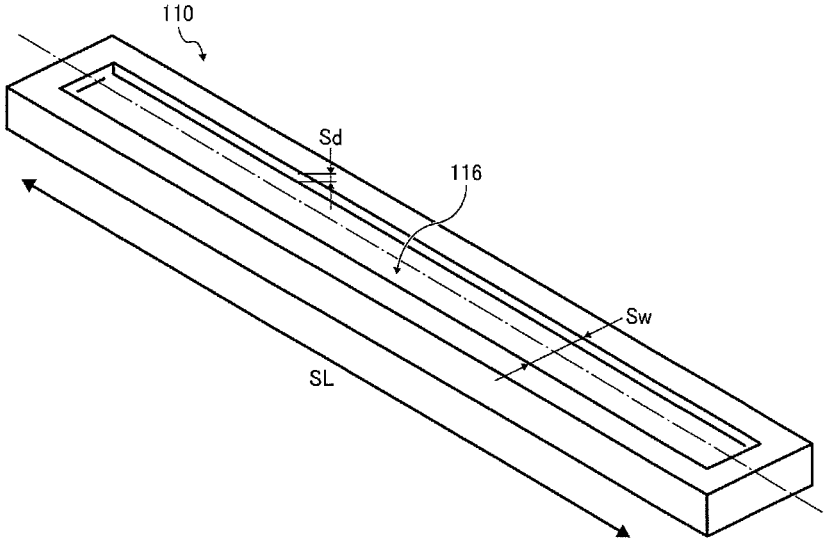
FIG. 6 illustrates a perspective view of a gas-jetting nozzle cap used for shielding the gas jetting nozzle.

FIG. 6 illustrates a perspective view of the gas-jetting nozzle cap 110 including the groove portion 116, which faces the plurality of gas jetting nozzles 94, in which a O-ring and a groove for O-ring which may be used with the gas-jetting nozzle cap 110 are omitted from a drawing. The groove portion 116 has a given length SL in a direction parallel to an arrangement direction of the plurality of gas jetting nozzles 94. Further, the groove portion 116 has a width Sw and a depth Sd.

When the gas-jetting nozzle cap 110 covers the plurality of gas jetting nozzles 94, the gas-jetting nozzle cap 110 may be fixed while substantially matching a center line of the plurality of gas jetting nozzles 94 and a center line (i.e., dotted line in FIG. 6) of the gas-jetting nozzle cap 110. The width Sw of the groove portion 116 is set greater than a size Dg of the gas jetting nozzle 94 or a short side of common slit opening. For example, the width Sw of the groove portion 116 is set to 150 μm to 2 mm. Further the depth Sd of the groove portion 116 is set to a given size so that a part of the gas-jetting nozzle cap 110 does not contact and damage an exit portion of the gas jetting nozzle 94. For example, the depth Sd of the groove portion 116 is set to 100 μm or greater.

With such a configuration, even if an arrangement size of the gas jetting nozzles 94 becomes longer by increasing the number of the gas jetting nozzles 94, the gas jetting nozzles 94 can be shielded effectively from an ambient atmosphere space existing around a transportation area set for recording medium and image forming area set for recording medium by the gas-jetting nozzle cap 110 because the gas-jetting nozzle cap 110 can be prepared in view of the number of plurality of gas jetting nozzles 94 and a length of arrangement direction.

Figure 7:
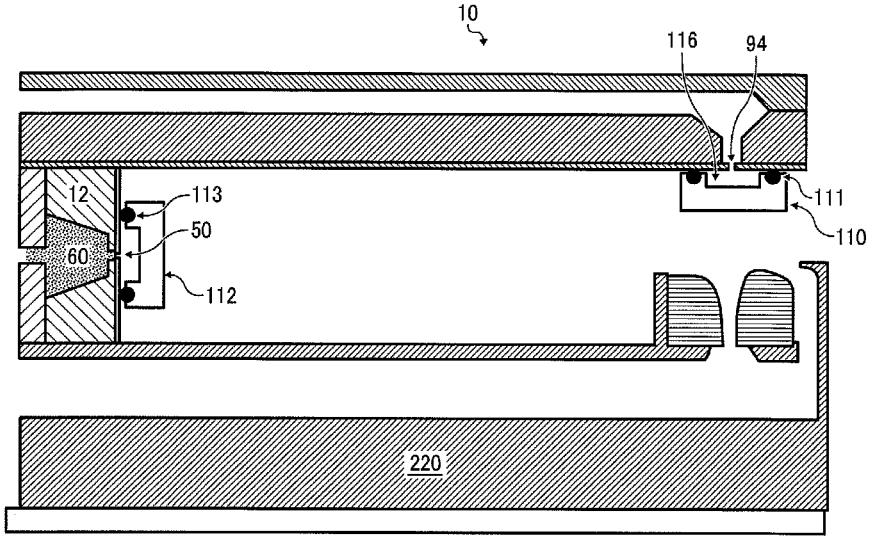
FIG. 7 illustrates a cross-sectional view of the continuous inkjet print head, in which the ink jetting nozzle is capped during a stop of image forming operation to prevent clogging of nozzle.

FIG. 7 illustrates another example embodiment of capping configuration, in which the gas-jetting nozzle cap 110 caps the plurality of gas jetting nozzles 94, and an ink jetting nozzle cap 112 caps a plurality of ink jetting nozzles 50 during a stop of image forming operation such as printing operation. The plurality of ink jetting nozzles 50 may be arranged in a given direction. By capping the ink jetting nozzles 50, ink drying at the ink jetting nozzle 50 can be prevented, and thereby clogging of ink jetting nozzle 50 can be prevented. Further, by capping the ink jetting nozzles 50, foreign material adhesion to the ink jetting nozzle 50 can be prevented, and thereby clogging of ink jetting nozzle 50 can be prevented. The ink jetting nozzle cap 112 can be provided with an elastic sealing member 113, made of fluoro plastic (e.g., fluoro rubber) having a high chemical resistance and shaped in O-ring shape.

As similar to the gas-jetting nozzle cap 110, the ink jetting nozzle cap 112 includes a groove portion having a slit shape extending in parallel to an arrangement direction of the plurality of the ink jetting nozzles 50. Further, the groove portion of the ink jetting nozzle cap 112 may be configured in parallel to the groove portion 116 of the gas-jetting nozzle cap 110.

Figure 8:
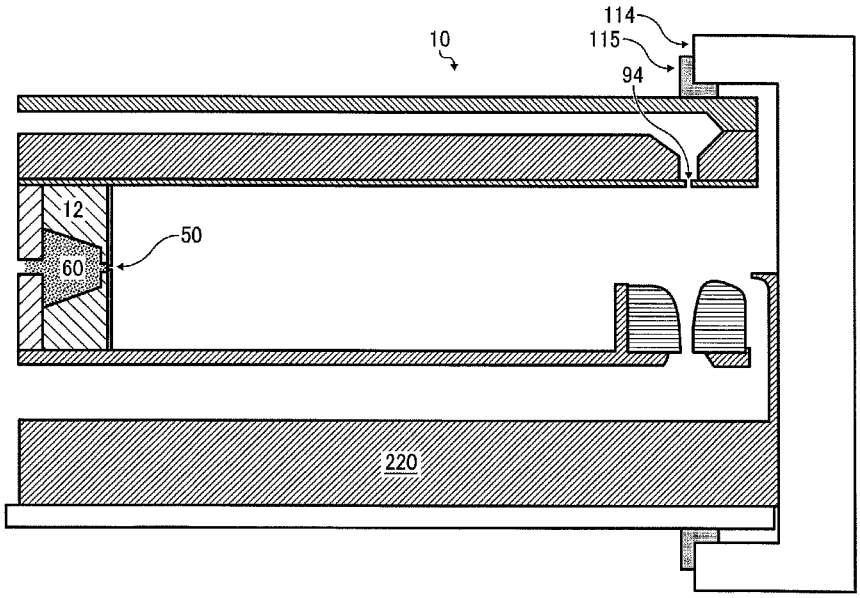
FIG. 8 illustrates a cross-sectional view of the continuous inkjet print head, in which the common cap is provided to enhance sealing performance.

FIG. 8 illustrates another example embodiment of capping configuration, which the common cap 114 caps or covers the continuous inkjet head 10. In such configuration, the common cap 114 caps or covers both of the plurality of gas jetting nozzles 94 (or common slit opening) and the plurality of ink jetting nozzles 50, and the common cap 114 is provided with an elastic sealing member 115, made of fluoro plastic (e.g., fluoro rubber) having high chemical resistance. The common cap 114, provided with the elastic sealing member 115, shields the gas jetting nozzle 94 and the plurality of the ink jetting nozzle 50 from paper powder (e.g., cellulose, tiny particles), fiber-like foreign materials, and/or particle-like foreign materials floating in an ambient atmosphere space existing around recording medium. As similar to the gas-jetting nozzle cap 110, the common cap 114 may include a groove portion 117 having a slit shape extending in parallel to an arrangement direction of the plurality of the ink jetting nozzles 50 of the continuous inkjet head 10. Further, the groove portion 117 of the common cap 114 may be configured in parallel to arrangement directions of the plurality of the ink jetting nozzles 50 and the gas jetting nozzle 94 (or common slit opening).

Figure 9:
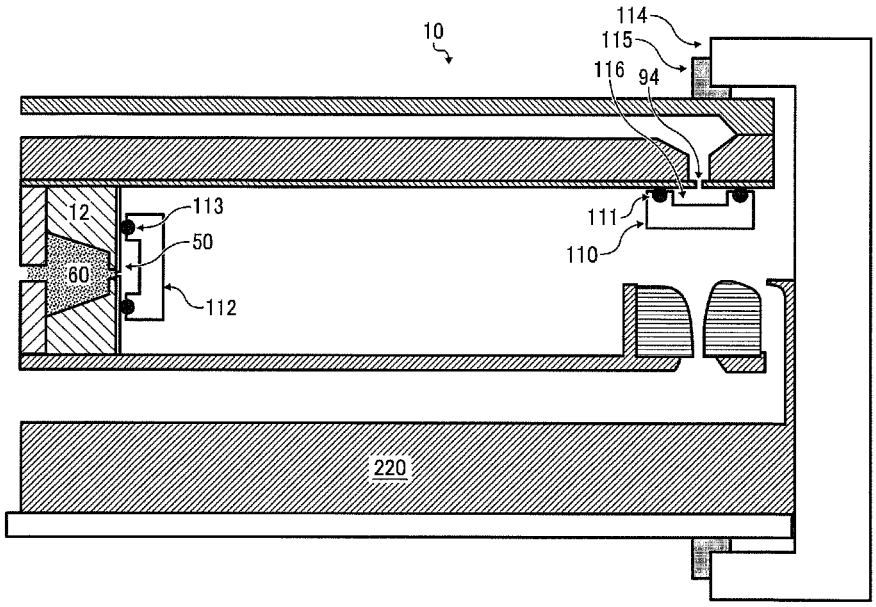
FIG. 9 illustrates a cross-sectional view of the continuous inkjet print head, in which the common cap is provided to enhance sealing performance, and another cap covers the ink jetting nozzle to prevent clogging, and a still another cap covers the gas jetting nozzle to shield the gas jetting nozzle from ambient atmosphere around a recording medium.

FIG. 9 illustrates another example embodiment of capping configuration. In such configuration, in addition to the common cap 114 provided with the elastic sealing member 115, the ink jetting nozzle cap 112 and the gas-jetting nozzle cap 110 are further provided to cap or cover the ink jetting nozzle 50 and the gas jetting nozzle 94 respectively. With such a configuration, clogging of ink jetting nozzle 50 can be prevented more effectively, and the gas jetting nozzle 94 can be shielded from an ambient atmosphere space existing around recording medium more effectively.

As above described, the gas jetting nozzle 94 can be shielded from an ambient atmosphere space existing around recording medium using configurations according to the above-described example embodiments, by which the gas flow 96 can be flown with a higher precision.

A description is now given to another aspect of example embodiments. As above described, in example embodiments according to the present invention, the gas flow 96 is jetted (or flown or blown) from the gas jetting nozzle 94 (i.e., microscopic nozzle) to correctly blow the gas flow 96 to ink droplets so that some ink droplets can be correctly guided to the gutter 206 and caught or captured as recovered ink. Further, when ink droplets having greater size and ink droplets having smaller size are formed depending on image information, and an air curtain flow is jetted from a common slit opening, the greater size ink droplets may used for image forming, and the smaller size ink droplets may not be used for image forming but caught or captured by the gutter 206. In such a case, the smaller size ink droplets may not need to be correctly guided to the gutter 206. Such ink catching or capturing operation can be conducted effectively if following two points can be set to a given level.

One point: Such ink catching operation of ink droplets can be conducted by maintaining a cleanliness level around an exit portion of the gas jetting nozzle 94. As above described, the gas jetting nozzle 94 and its surroundings can be shielded from an ambient atmosphere space existing around recording medium to maintain the cleanliness level. By maintaining the cleanliness level at a preferable level, the gas flow 96 can be jetted in a desired direction. If the cleanliness level around the gas jetting nozzle 94 is not good, the gas flow 96 may be jetted in un-desired direction. Similarly, when the common slit opening is used, a cleanliness level around an exit portion of the common slit opening needs to be maintained at a preferable level so that gas flow speed of air curtain flow may not be fluctuated locally.

Another point: cleanliness level of the gas flow 96 itself or air curtain flow itself. As above described, the gas jetting nozzle 94 has an opening having a size Dg, which may be ϕ25 μm to ϕ8 μm, and the common slit opening has a short side of 50 μm to 100 μm, for example. Accordingly, if tiny amount of dust, foreign materials or the like intrude in the gas flow 96, such dust or foreign materials may clog the gas jetting nozzle 94 or the common slit opening. Further, if dust or foreign materials adheres a part of the gas jetting nozzle 94 or the common slit opening, the gas flow 96 may not be jetted to a desired direction, and thereby the gas flow 96 cannot be blown to ink droplets, by which ink droplets cannot be guided to the gutter 206. Further, the air curtain flow jetted from the common slit opening cannot guide small ink droplets to the gutter 206.

In view of such cleanliness issue, the gas flow 96 or the air curtain flow used in example embodiments may have a cleanliness level, which is at the same level of clean air used for LSI (large-Scale integrated circuit) manufacturing process. Specifically, a given gas is filtered by HEPA (High Efficiency Particulate Air Filter) to remove foreign dust or materials, by which cleaned gas can be flown as the gas flow 96. For example, the cleanliness level of cleaned gas may be set to Class 100 cleanliness (the number of dust having a diameter of 0.3 μm or greater per one cubic feet is 100 or less). Such cleaned gas may be air, which may be used as airflow, for example, but not limited these.

With such a configuration, the cleanliness level around an exit portion of the gas jetting nozzle 94 or the common slit opening can be maintained at a preferable level, and the cleanliness level of the gas flow 96 jetted from the gas jetting nozzle 94 or the common slit opening can be maintained at a preferable level. Under such condition, clogging of the gas jetting nozzle 94 or the common slit opening can be prevented, a gas flowing deviation of gas flow 96 from a desired direction can be prevented, and the gas flow speed of air curtain flow from the common slit opening may not fluctuate locally.

As such, the gas flow 96 may be air, which may be cleaned by using a filter, but another gas can be used similarly. For example, nitrogen gas cleaned by a filter can be used.

A description is now given to another aspect of example embodiments. Gas such as air is used as a viscous fluid. When gas (e.g., air) flows, such gas flow may include a laminar flow or a turbulent flow. For understating such laminar flow and turbulent flow, assume a gas flow in a hollow cylinder. When fluid particles (i.e., air) in each of layers in the hollow cylinder flow in parallel to a cylinder axis direction, such gas flow may be referred to as laminar flow. In contrast, when fluid particles (i.e., air) in each of layers in the hollow cylinder are flowing while fluid particles are being mixed each other with irregular manner, such gas flow may be referred to as a turbulent flow. Accordingly, when another fluid (e.g., ink droplet) may exist in such turbulent gas flow, such another fluid is included in an irregular gas flow with dispersed condition. In example embodiments, if a jetting condition of the gas flow 96 is not good, ink droplets may be dispersed with irregular manner, by which dispersed ink may adhere on the recording medium 300, and thereby image quality may degrade.

The laminar flow and turbulent flow can be quantitatively determined using Reynolds number as below explained. When the fluid kinematic viscosity coefficient is set to "γ," the average flow speed is set to "u," the inner diameter of the hollow cylinder is set to "d," Reynolds number, which is dimensionless number, can be obtained by using the following equation.

$$R=ud/\gamma$$

When the Reynolds number becomes a given value or less, the gas flow may be referred to as a laminar flow. When the Reynolds number becomes a given value or greater, the gas flow may be referred to as a turbulent flow. The gas flow may change its flow pattern from the turbulent flow to the laminar flow, or from the laminar flow to the turbulent flow at a given Reynolds number. Such Reynolds number may be referred to as "critical Reynolds number (Rc)," which can be obtained as following number based on researches by scientists.

$$Rc=2310$$

Typically, the critical Reynolds number means a minimum critical Reynolds number, by which "Rc" number is a minimum critical Reynolds number.

Specifically, a laminar flow can be generated as below. For example, assume a hollow cylinder having an inner diameter "d" of 0.015 mm, and kinematic viscosity coefficient γ of air of about $149.2\times10^{-7}$ $m^2/s$ under 1 atmosphere and 20 degrees Celcius. When such values are used, following value can be computed.

$$u = Rc\times\gamma/d$$

$$= 2310\times149.2\times10^{-7}\ (m^2/s)/0.015\ (mm)$$

$$= \text{about } 2.3\ (m/s)$$

Accordingly, when gas (e.g., air) flow speed is set to about 2.3 m/s or less, Reynolds number can be set to the minimum critical Reynolds number or less, by which a laminar flow can be generated inside the hollow cylinder.

In other words, a gas flow can be flown in example embodiments as below. An opening size Dg of the gas jetting nozzle 94 may be set to ϕ15 μm, for example, and depth direction of the gas jetting nozzle 94 is set to 30 μm to 5 μm, typically. Then, cleaned gas flow having received pressure adjustment at the pressurized gas-flow inlet 95 is flown at a given pressure so that the gas flow passing through the depth direction of the gas jetting nozzle 94 can be jetted at a speed of about 2.3 m/s or less. With such configuration, Reynolds number of the gas flow passing the gas jetting nozzle 94 becomes a minimum critical Reynolds number or less, which can generate a laminar flow. Accordingly, undesired whirlpool flow may not be generated, and gas flow may not be disturbed.

As such, a size of gas jet nozzle and gas flow speed may be set to given values so that Reynolds number of gas flow passing the gas jetting nozzle 94 becomes the minimum critical Reynolds number or less, by which undesired whirlpool flow may not be generated, and gas flow may not be disturbed.

Such condition settings may be conducted using a gas flow visualization apparatus and a component equivalent to the gas jetting nozzle 94 because such condition settings may not be conducted using an actual apparatus. In such gas flow visualization apparatus, a tracer such as tobacco smoke (having particle size of 1 μm or less) or dry ice may be used to observe gas flow around an exit portion of the component equivalent to the gas jetting nozzle 94 to confirm a condition of laminar flow condition. Similarly, such gas flow speed setting can be set for the common slit opening using such visualization apparatus and an equivalent component of the common slit opening, by which undesired whirlpool flow may not be generated, and gas flow of air curtain flow may not be disturbed.

A description is now given to another aspect for example embodiments. As above described, the continuous inkjet recording apparatus has an high ink-droplet-formation frequency, and may be suitable for high speed printing, high speed throughput, large-volume printing. Accordingly, as illustrated in FIG. 2, the continuous inkjet head 10 is fixed at a given position, and the recording medium 300 is transported under the continuous inkjet head 10.

In such configuration, the recording medium 300 may be transported with a high speed, for example. Accordingly, the recording medium 300 may disturb air flow around the recording medium 300. In example embodiments, the gas flow 96 is jetted from the gas jetting nozzle 94, and the gas flow 96 may blow ink droplets not used for image forming operation to the gutter 206. Although air flow disturbance may be generated by the recording medium 300 transported with a high speed, such air flow disturbance may not be allowed to disturb the gas flow 96.

For example, to prevent such air flow disturbance, the gas flow 96 may be flown in one direction with a speed Vg as shown in FIG. 2 (i.e., downward direction in FIG. 2), and the recording medium 300 may be transported in a substantially same direction of the gas flow 96 with a speed Vp (see an arrow direction of the recording medium 300 in FIG. 2) to prevent an air flow going to an opposite direction of gas flow direction shown by the arrow having the speed Vg. The recording medium 300, transported as endless form (undivided form), passes an image forming operation area with a speed Vp, which is a substantially same direction of gas flow direction shown by the arrow having the speed Vg. Under such a configuration, the recording medium 300 can be transported with a high speed without disturbing the gas flow 96 because the recording medium 300 passes an image forming operation area with a speed Vp, which is a substantially same direction of gas flow direction shown by the arrow having the speed Vg. If the recording medium 300 is transported in an opposite direction with respect a gas flow direction of gas flow 96, the gas flow 96 may be disturbed.

A description is now given to another aspect for example embodiments. The continuous multi-nozzle inkjet recording apparatus according to example embodiments is different from a conventional continuous inkjet recording apparatus having an electrostatic charging device as described in U.S. Pat. No. 7,413,239. Accordingly, an electrostatic charging device is not required for each of nozzles for the continuous multi-nozzle inkjet recording apparatus according to example embodiments. The conventional continuous inkjet recording apparatus using the electrostatic charging devices can arrange a relatively small number of nozzles such as for example image-dot density of 50 dpi or so.

In contrast, the continuous multi-nozzle inkjet recording apparatus according to example embodiments can arrange a relatively great number of nozzles such as for example image-dot density from 600 dpi to 2400 dpi, by which the nozzle arrangement corresponding to the image-dot density can be obtained, and corresponding image quality can be obtained. However, such higher density arrangement of nozzles may have some issue.

For example, assume a case that "n" nozzles are arranged in one row, in which "n" is natural number of 3 or greater ($n \geq 3$). In such arrangement, ink droplet stream jetted from the 1st (first) nozzle and ink-droplet stream jetted from the (n)th nozzle have different environment compared to ink-droplet stream jetted from the 2nd (second) to (n−1)th nozzle.

Specifically, as for the ink-droplet stream jetted from the 1st nozzle and (n) th nozzle, another ink-droplet stream exists just one side of the 1st nozzle or (n) th nozzle, an only air exists other side of the 1st nozzle or (n) th nozzle but ink-droplet stream does not exist.

In contrast, as for the ink-droplet stream jetted from the 2nd nozzle to (n−1)th nozzle, adjacent ink-droplet streams exist on both sides of one ink-droplet stream jetted from the 2nd nozzle to (n−1)th nozzle. Accordingly, when ink-droplet streams are jetted from all nozzles of the 1st nozzle to (n) th nozzle, ink-droplet streams jetted from the 2nd nozzle to the (n−1)th nozzle may receive air-resistance-reduction effect from adjacent ink-droplet streams existing at both sides, although such effect may be small.

In contrast, ink-droplet streams jetted from the 1st nozzle and the (n) th nozzle have just airspace on one side, by which such ink-droplet streams jetted from the 1st nozzle and the (n) th nozzle may receive air resistance from the air. Accordingly, ink-droplet streams jetted from the 1st nozzle and the (n) th nozzle may have a jet speed smaller than ink-droplet streams jetted from the 2nd nozzle to the (n−1)th nozzle.

In example embodiments, in view of such air resistance, following configuration may be used. For example, when "n" nozzles are arranged in one row, ink-droplet streams jetted from the 2nd nozzle to the (n−1)th nozzle may be actually used for image forming operation, but ink-droplet streams jetted from the 1st nozzle and the (n) th nozzle may not be used for image forming operation. The ink-droplet streams jetted from the 1st nozzle and the (n) th nozzle may be jetted as a dummy jet, and captured or caught by the gutter 206. Accordingly, ink-droplet stream jetted from the 1st nozzle may be jetted to prevent air resistance effect to ink-droplet stream jetted from the 2nd nozzle; ink-droplet stream jetted from the (n) th nozzle may be jetted to prevent air resistance effect to ink-droplet stream jetted from the (n−1)th nozzle.

As such, one dummy nozzle is provided at both end of the ink jetting nozzles, used for image forming operation. More preferably, the 1st and 2nd nozzles, and the (n−1)th and (n) th nozzles may be used as dummy nozzles, which jet dummy jet of ink-droplet stream, and ink-droplet stream jetted from the 3rd nozzle to the (n−2)th nozzle may be actually used for image forming operation. As such, one or more dummy nozzles may be provided at both end of the ink jetting nozzles, used for image forming operation.

As similar to ink-droplet stream used for image forming operation, the dummy jet may also receive an effect of ink droplet formation, and deflection, and then may be caught or captured by the gutter 206 by an effect of gas flow. Accordingly, as similar to nozzles used for image forming operation, a heater and gas jet nozzle may also be provided for nozzles jetting the dummy jet. Further, when ink droplets having different mass are formed and a gas flow is jetted from a common slit opening, the dummy jet may need to be guided to the gutter 206. Accordingly, the dummy jet may form all ink droplets as smaller mass ink droplets, and the smaller mass ink droplets may be defected by a gas flow of air curtain flow and caught or captured by the gutter 206 effectively.

As such, ink-droplet streams used for image forming operation can be jetted at a uniform speed by setting the dummy jet as such, which may be called as an assisting effect of dummy jet. Such dummy jet may be effective because of high density arrangement of nozzles set for the present invention such as for example image-dot density from 600 dpi to 2400 dpi. In a conventional continuous inkjet recording apparatus using an electrostatic charging device, a nozzle arrangement density may be relatively small such as for example image-dot density of 50 dpi or so. In this case, an interval of each of ink-droplet streams may be too distanced each other, by which each of the ink-droplet streams may receive air resistance in a similar manner. Accordingly, as for a conventional continuous inkjet recording apparatus using an electrostatic charging device having a lower nozzle arrangement density such as for example image-dot density of 50 dpi or so, a dummy jet according to an example embodiment may not exert preferable effect.

Further, even in example embodiments, if a lower nozzle arrangement density such as for example image-dot density of 50 dpi or so is employed, the dummy jet according to an example embodiment may not exert preferable effect as similar to the conventional continuous inkjet recording apparatus using an electrostatic charging device. As such, the dummy jet according to an example embodiment may exert preferable effect when a higher nozzle arrangement density such as for example image-dot density from 600 dpi to 2400 dpi or so is employed.

In view of such dummy jet, the gutter 206 used as an ink catching or capturing unit may have a given size that can catch or capture ink jetted from one or more ink jetting nozzles disposed at both end of the ink jetting nozzle array. As such, the gutter 206 may have the given size in the nozzle arrangement direction. Further, as for the common cap used for the gas jet nozzle and ink jetting nozzle, the common cap may have a given size that can cover one or more ink jetting nozzles disposed at both end of the ink jetting nozzle array and corresponding gas jet nozzle array. As such, the common cap may have the given size in the nozzle arrangement direction.

A description is now given to another aspect for example embodiments. In the continuous multi-nozzle inkjet recording apparatus according to example embodiments, ink droplets used for image forming operation may adhere on the recording medium 300 while ink droplets not used for image forming operation may be caught or captured by the gutter 206.

While to-be-captured ink droplets fly in air as microscopic ink droplet, water component vaporizes for water-based ink, or solvent component vaporizes for solvent-based ink, by which recovered ink may typically have higher viscosity. Such higher viscosity recovered ink may be discarded in conventional apparatuses. In example embodiments, the recovered ink may be returned to the ink supply unit 418 and re-used by the ink recovery/re-use unit 416 (see FIG. 1).

Such higher viscosity recovered ink may have ink property different from fresh ink such as condition for forming microscopic particles (i.e., ink droplets). Due to such ink property difference, the higher-viscosity recovered ink itself may not be re-used for forming microscopic particles (i.e., ink droplets). Accordingly, in example embodiments, in the ink recovery/re-use unit 416, recovered ink having higher viscosity may be added with water or solvent to prepare ink having lower viscosity (which is substantially same as viscosity of fresh ink), in which a viscosity detector may be used to set a preferable viscosity. Further, such recovered ink having higher viscosity may include the cellulose 100, tiny particle 101, fiber-like foreign material 102, and particle-like foreign material 103 shown in FIG. 4. Accordingly, when the recovered ink is to be re-used, the ink recovery/re-use unit 416 may need a filtering function to filter such foreign materials.

A description is now given to another aspect for example embodiments. The continuous multi-nozzle inkjet recording apparatus according to example embodiments employs a plurality of nozzles to jet ink or ink droplets, in which each of ink droplets is controlled with higher precision to conduct high quality image forming operation such as for example 600 dpi to 2400 dpi resolution. In such continuous multi-nozzle inkjet recording apparatus, ink is jetted from an ink jetting nozzle, and then an ink column and an ink droplet stream are formed. Specifically, jetted ink forms the ink column, and then ink droplets are separated from a leading edge of the ink column. Such separated ink droplets may form the ink droplet stream. Accordingly, ink droplets need to be broken from the ink column at a desired position, and the ink column and/or ink droplet stream may not be allowed to be deviated from an intended position or direction, which means curving of jetting direction of ink column and a deflection of ink droplet (or ink droplet stream) from a desired direction may not be allowed.

Figure 10:
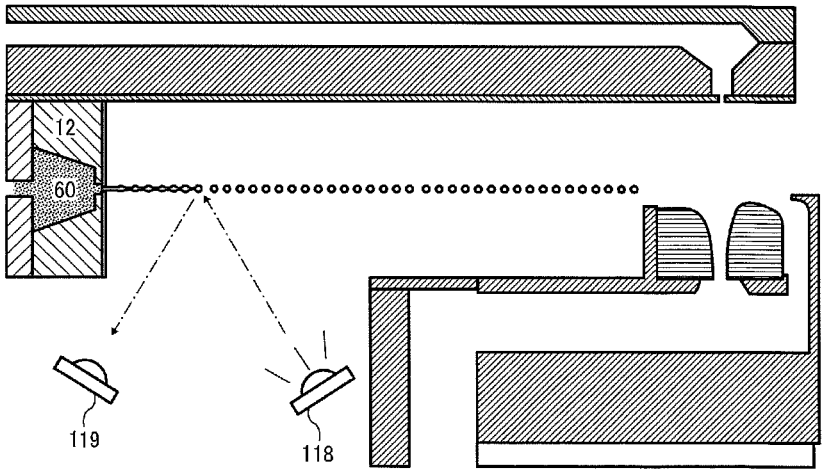
FIG. 10 illustrates a cross-sectional view of the continuous inkjet print head, in which curving of jetting direction of ink droplet is detected using a detector.

To monitor or check such curving of jetting direction of ink column and a deflection of ink droplet, a curving detection unit or monitoring unit may be disposed for the continuous inkjet head 10. An example configuration of the curving detection unit or monitoring unit is shown in FIG. 10. In example embodiments, a light-emitting unit 118 and a light-receiving unit 119 may be disposed as shown in FIG. 10 to detect curving of jetting direction of ink column and a deflection of ink droplet (or ink droplet stream). As shown in FIG. 10, the light-emitting unit 118 and the light-receiving unit 119 may be disposed at a same side, for example, to detect a reflection light from the ink droplet to monitor or check such curving of jetting direction of ink column and a deflection of ink droplet. However, the light-emitting unit 118 and the light-receiving unit 119 can be disposed at opposite positions by interposing the ink column therebetween, in which a translucent light of the ink droplet is used to monitor or check such curving of jetting direction of ink column and a deflection of ink droplet. For example, The light-emitting unit 118 may be light emitting element such as for example light emitting diode (LED), laser diode (LD), or the like, and the light-receiving unit 119 may be a photodiode, charge couple device (CCD) image sensor, CMOS (complementary metal-oxide semiconductor) image sensor, or the like.

At a timing of applying a drive voltage for heat pulse shown in FIGS. 3A, 3B, and 3C, the light-emitting unit 118 flashes light to the ink column or ink droplet, and then the light-receiving unit 119 detects the ink column and/or ink droplet as an image such as back image having a given concentration. By synchronizing an application timing of a drive voltage for heat pulse and a flash timing of the light-emitting unit 118 and observing the ink column and/or ink droplet under such condition, a standing wave of ink column surface and static condition of discrete ink droplets can be observed.

Further, instead of the light-emitting unit 118 and the light-receiving unit 119, a monitoring system using an image capture element such as CCD camera can be used to monitor ink column and/or ink droplet, in which camera image may be observed.

Further, such monitoring unit can be disposed with different manner. In another example, the light-emitting unit 118 and the light-receiving unit 119, or image capture element (e.g., CCD camera) can be disposed for each of a plurality of nozzles, by which all ink columns existing in a nozzle arrangement direction can be checked. In another example, one monitoring unit is disposed and such monitoring unit is moved in a nozzle arrangement direction to check all ink columns.

Figure 11:
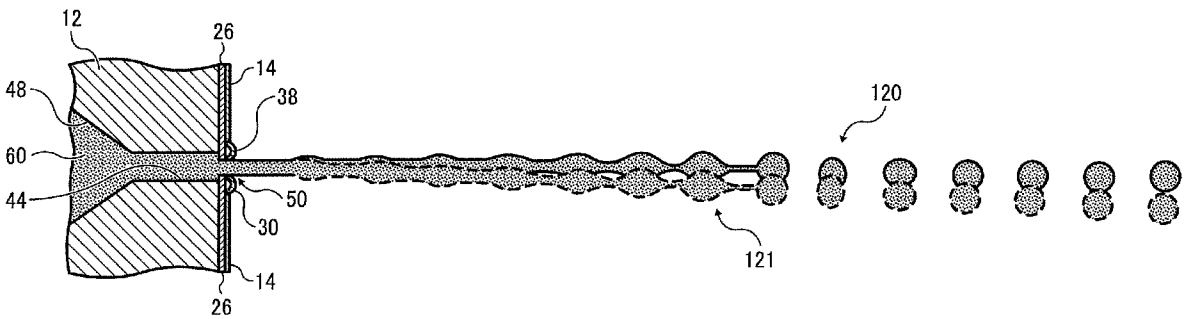
FIG. 11 illustrates an example curving phenomenon of jetting direction of ink droplet in the continuous inkjet print head.

FIG. 11 shows an example state of ink column breaking and ink droplet formation. When ink is jetted at a preferable condition for forming ink droplets, the straightforward ink 120 is formed. In contrast, when a jetting direction of ink is curved (or deviated) from a desired position due to some reasons, a jetting-direction-failed ink 121 is formed. Typically, the jetting-direction-failed ink 121 may be formed when foreign materials adhere on the ink jetting nozzle 50, in which the ink jetting nozzle 50 is not clogged completely, wherein such state of ink jetting nozzle 50 can be referred to semi-clogging phenomenon.

A description is given to another detectable inconvenient phenomenon such as ink column breaking length failure. The ink column breaking length failure may be related to curving of jetting direction of ink column and a deflection of ink droplet.

Even if foreign materials adhere on the ink jetting nozzles 50, it may be observed that ink column and ink droplet may fly in a straightforward direction without curving phenomenon of jetting direction of ink column and a deflection of ink droplet. However, if foreign materials adhere on the ink jetting nozzles 50, a desired ink column breaking and ink droplet separation cannot be conducted. If such foreign materials adhesion occurs, a distance from the exit of ink jetting nozzle 50 to the ink column breaking point may become shorter than a desired ink column breaking length.

Further, if air bubbles exist inside ink jetting nozzle 50, such bubbles may cause an unstable condition for ink. For example, the ink column breaking point fluctuates, by which storobo flash cannot be synchronized with ink jetting movement, and thereby ink column of static state may not be observed. Such inconvenient phenomenon may be one of ink column breaking length failure.

If an image forming operation is conducted under such inconvenient phenomenon condition such as curving of jetting direction or ink column breaking length failure, ink droplets may not impact on or strike an intended position on the recording medium 300, by which image having poor image quality may be produced. Accordingly, when such undesired condition (e.g., curving of jetting direction, ink column breaking length failure) occurs, an image forming operation may need to be stopped to save resources such as recording medium and ink.

Further, the above described curving of jetting direction, which is one inconvenient phenomenon, may be referred to as semi-clogging phenomenon, in which the ink jetting nozzle 50 is partially clogged. When the ink jetting nozzle 50 is completely clogged by foreign materials or dried ink, such condition may be referred to as complete-clogging phenomenon. When such semi-clogging phenomenon or complete-clogging phenomenon occurs, an image forming operation may need to be stopped.

In example embodiments, when such complete-clogging phenomenon or semi-clogging phenomenon occurs, an image forming operation is stopped, and then a correction process may be conducted to fix such inconvenient condition. As above described, the curving of jetting direction or clogging of the ink jetting nozzle 50 by foreign materials or dried ink may occur under the complete-clogging phenomenon or semi-clogging phenomenon.

As above described with reference to FIG. 7, the ink jetting nozzle cap 112 is provided to cover a plurality of ink jetting nozzles 50. The ink jetting nozzle cap 112, which is a single common cap, covers the ink jetting nozzles 50. In example embodiments, the ink jetting nozzle cap 112 may be further provided with an enhanced functionality. Specifically, the ink jetting nozzle cap 112 may be further provided with a function of refreshing unit. Such ink jetting nozzle cap 112 can be used as a cap for capping the ink jetting nozzles 50 and an ink suction unit to cover the entire ink jetting nozzles 50 and to suck ink such as dried ink adhered on the ink jetting nozzles 50. With such a configuration, when the ink jetting nozzle cap 112 caps the ink jetting nozzles 50, dried and sticked ink on the ink jetting nozzle 50 can be sucked from the exit side of the ink jetting nozzle 50, by which clogging of ink jetting nozzle 50 can be restored, by which the ink jetting nozzle 50 can be set to a normal condition.

As such, when an inconvenient phenomenon such as curving of jetting direction is detected, an image forming operation is not continued, but the image forming operation is stopped as above described. Then, based on detection information of curving of jetting direction, the refreshing unit is activated so that curving phenomenon of jetting direction can be fixed to a preferable level. Then, after fixing the curving of jetting direction, an image forming operation is resumed. With such a configuration, image quality degradation caused by the curving of jetting direction can be prevented, and to-be-used resource amount such as recording medium or ink can be saved.

A description is given to ink used for the continuous inkjet recording apparatus according to example embodiments. The continuous inkjet recording apparatus can use conventionally available inkjet ink as ink.

Typically, ink may be mainly composed of liquid medium, recording agent, and additives, for example. The liquid medium solves the recording agent used for forming image and additives are added to set a desired property. Types and component ratio of liquid medium and additives may be selected to adjust viscosity and surface tension at a given value so that ink droplet, which is suitably, used for example embodiments, can be formed. For example, when the viscosity is set to 0.5 cP to 30 cP (at 20 degrees Celcius), and the surface tension is set to $1\times10^{-2}$ to $6\times10^{-2}$ N/m (10 to 60 dyn/cm at 20 degrees Celcius), a preferable ink droplet usable for example embodiments can be prepared.

The continuous inkjet recording apparatus according to example embodiments may employ a mechanism for forming ink droplet and a mechanism for flying ink droplets, deflecting in air. Such mechanisms are different from mechanisms used for a conventional continuous inkjet recording apparatus using an electrostatic charging device. In case of conventional continuous inkjet recording apparatus, ink type may be limited to water-based ink, and ink may need to have conductivity. In contrast, the continuous inkjet recording apparatus according to example embodiments may not have such conditional limitation. Accordingly, if ink satisfies the above described viscosity and/or surface tension, any types of ink can be used, wherein such ink may be water-based ink, non-water-based ink (solvent-based ink), dissoluble ink, conductive ink, and insulation ink, but not limited thereto.

Further, ultraviolet ink (UV ink) can be preferably used. The UV ink may be referred to as ultraviolet-curing ink, which may include ultraviolet-curing reaction initiator. When the UV ink is used, the UV ink can be instantly cured as below. For example, an ultraviolet (UV) irradiation source such as light emitting diode (LED) or laser diode (LD) may be used to irradiate ultraviolet ray on the recording medium 300, in which the ultraviolet ray having light emitting wavelength peak of 350 on to 420 nm and maximum illuminance of 10 to 1,000 mW/cm$^2$ is irradiated on the recording medium 300 to cure the UV ink instantly. Such UV irradiation source may be UV-LED, UV-LD, or the like.

Further, DV ink can be cured using other activation energy source such as mercury lamp, metal halide lamp, gas/solid laser, or the like. Such UV irradiation can cure ink instantly, which cannot be conducted by a conventional apparatus. Accordingly, the UV ink may be preferable ink for the continuous inkjet recording apparatus according to example embodiments, which has high-speed throughput performance, and needs to conduct an ink drying process (or curing) within a short time.

Further, a component ratio of recording agent can be set to a given value, which can obtain desired image recording concentration. For example, when the component ratio of recording agent is set to from 0.2 wt % to 10 wt % (weight %) in ink, dye ink and pigment ink can be used as ink for example embodiments.

The above described example embodiments according to the present invention may include following features. A multi-nozzle inkjet recording apparatus according to example embodiments includes a multi-nozzle inkjet head, which may be fixed at a given position, and a recording medium may be transported in one direction near the multi-nozzle inkjet head when to conduct an image forming operation. The recording medium may be transported as an endless form (undivided form) when the recording medium passes through an image forming area. Accordingly, the recording medium can be transported with a high speed, by which the continuous multi-nozzle inkjet recording apparatus can conduct high-speed image forming such as for example high speed and large-scale throughput. If the transported recording medium may be cut sheets, such cut sheets may be transported one by one, and thereby high speed throughput cannot be conducted.

The multi-nozzle inkjet recording apparatus may include a common cap for capping a gas jetting nozzle and/or ink jetting nozzle. In such configuration, a structure or mechanism of cap can be simplified, and ink jetting flow and gas jetting flow can be maintained at a preferable level.

Further, in the multi-nozzle inkjet recording apparatus, a size of gas jetting nozzle and a gas flow speed may be set to given values and such values are used in combination so that a gas flow has a minimum critical Reynolds number or less when the gas flow passes through the gas jetting nozzle. With such a setting, the gas flow (or air curtain flow) can be jetted from the gas jetting nozzle effectively, which means a flow direction of gas flow may not dispersed unnecessarily, or a whirlpool may not occur in the gas flow. By using such gas flow jetted in a desired direction, the gas flow can be effectively blown to flying ink droplets with a higher precision. Specifically, a flying direction of ink droplets, not to be used for image forming, can be changed in a given direction to recover such ink droplets, by which ink droplets, not to be used for image forming, may not adhere on a recording medium, and thereby a high quality image can be produced.

Further, in the multi-nozzle inkjet recording apparatus, when a recording medium passes through an image forming area as an endless form (undivided form), the recording medium may be transported into one direction, which is a substantially same direction as a flow direction of gas flow. With such a configuration, an air flow, which may be generated by a being-transported recording medium, may not disturb the gas flow jetted from the gas jetting nozzle. Therefore, the gas flow can be effectively blown to flying ink droplets with a higher precision. Specifically, a flying direction of ink droplets, not to be used for image forming, can be changed in a given direction to recover such ink droplets, by which ink droplets, not to be used for image forming, may not adhere on a recording medium, and thereby a high quality image can be produced.

Further, in the multi-nozzle inkjet recording apparatus, the multi-nozzle inkjet head have a nozzle arrangement having a given image-dot density such as for example 600 dpi to 2400 dpi. The ink jetting nozzle portion of multi-nozzle inkjet head includes the number of ink jetting nozzles, wherein each of the ink jetting nozzles may be surrounded by a heater or heaters. In example embodiments, one or more ink jetting nozzles disposed at both ends of ink jetting nozzle portion may be used to form and jet smaller mass ink droplets, which can be deflected by a gas flow and caught or captured by a gutter unit. Such one or more ink jetting nozzles may be referred to as "end nozzle." By jetting dummy ink from the "end nozzle," ink droplets jetted from ink jetting nozzles other than the "end nozzle" may be free from an effect of air resistance, by which ink droplets used for image forming can fly in a desired direction, and thereby a high quality image can be produced.

Further, in the multi-nozzle inkjet recording apparatus, a gutter unit may have a given size, which can catch ink column jetted from the "end nozzle" disposed at both ends of the ink jetting nozzle portion. Accordingly, even if the dummy ink is jetted from the "end nozzle", the gutter unit can catch or capture such dummy ink effectively.

Further, in the multi-nozzle inkjet recording apparatus, an ink recovery/re-use unit and an ink supply unit may be provided to re-use ink recovered by the ink recovery/re-use unit. The recovered ink can be supplied again to the multi-nozzle inkjet head using the ink supply unit. With such a configuration, ink, not used for image forming, may not be wasted, by which a running cost of inkjet recording apparatus can be reduced.

Further, in the multi-nozzle inkjet recording apparatus, a light emitting unit and a light receiving unit may be disposed near an ink column to detect curving of jetting direction of ink column and a deflection of ink droplets, wherein such curving of jetting direction and deflection may be an inconvenient phenomenon. When such inconvenient phenomenon occurs and is detected, an image forming operation is stopped. With such a configuration, it can be determined whether an image forming operation can be continued. Because the image forming operation can be stopped when a curving of jetting direction is detected, image forming resources such as recording medium, ink, or the like can be saved. If the image forming operation is not stopped, image forming resources such as recording medium and ink may be wasted.

Further, in the multi-nozzle inkjet recording apparatus, a light emitting unit and a light receiving unit may be disposed near an ink column to detect an ink column breaking length failure, which is an inconvenient phenomenon. When such inconvenient phenomenon occurs and is detected, an image forming operation is stopped. With such a configuration, it can be determined whether an image forming operation can be continued. Because the image forming operation can be stopped when an ink column breaking length failure is detected, image forming resources such as recording medium, ink, or the like can be saved. If the image forming operation is not stopped, image forming resources such as recording medium and ink may be wasted.

Further, in the multi-nozzle inkjet recording apparatus, an image capturing device may be disposed to monitor an ink column and ink droplets. Specifically, the image capturing device is used to detect curving of jetting direction of ink column and a deflection of ink droplet, which are inconvenient phenomenon. When such inconvenient phenomenon occurs and is detected, an image forming operation is stopped. With such a configuration, it can be determined whether an image forming operation can be continued. Because the image forming operation can be stopped when such curving of jetting direction or deflection is detected, image forming resources such as recording medium, ink, or the like can be saved. If the image forming operation is not stopped, image forming resources such as recording medium and ink may be wasted.

Further, in the multi-nozzle inkjet recording apparatus, an image capturing device may be disposed to detect ink column breaking length failure, which is inconvenient phenomenon. When such inconvenient phenomenon occurs and is detected, an image forming operation is stopped. With such a configuration, it can be determined whether an image forming operation can be continued. Because the image forming operation can be stopped when an ink column breaking length failure is detected, image forming resources such as recording medium, ink, or the like can be saved. If the image forming operation is not stopped, image forming resources such as recording medium and ink may be wasted.

Further, in the multi-nozzle inkjet recording apparatus, a refreshing unit may be disposed to cover the ink jetting nozzle portion and to suck ink from the ink jetting nozzle. The refreshing unit may be activated based on detection information such as detection of curving of jetting direction, which is an inconvenient phenomenon. Accordingly, even if the curving of jetting direction occurs due to a contamination of ink jetting nozzle such as clogging, the refreshing unit can restore the ink jetting nozzle to a preferable condition, and then an image forming operation can be resumed. With such a configuration, the multi-nozzle inkjet recording apparatus can produce high quality images reliably.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, the multi-nozzle inkjet head comprising:

a liquid chamber to supply pressurized ink to the ink jetting nozzles;

an ink nozzle plate, attached to the liquid chamber, including the plurality of ink jetting nozzles arranged in a given direction with a given arrangement density to jet the pressurized ink from the liquid chamber;

a heating unit including a heater having a film structure and disposed in close proximity to each of the plurality of the ink jetting nozzles, the ink jetting nozzles and the heating unit being integrated as a multiple-ink-nozzle plate, the heating unit stimulates the pressurized ink at an exit opening of each of the ink jetting nozzles to separate ink droplets from a leading edge of the ink column jetted from each of the ink jetting nozzles, the separated ink droplets flying in a given direction;

a gas flow applicator disposed adjacently to the liquid chamber to apply a gas flow to the flying ink droplets from a given direction to a flying direction of the flying ink droplets, the gas flow applicator including an opening to jet the gas flow;

a cap to shield an area of the gas flow from an ambient atmosphere space existing around a transporting and image forming area for the recording medium; and a gutter unit disposed between the area of the gas flow and the transporting area of the recording medium to catch ink droplets that change the flying direction with an application of the gas flow to the flying ink droplets, ink droplets not caught by the gutter unit being directed onto the recording medium to form an image on the recording medium.

2. The continuous multi-nozzle inkjet recording apparatus according to claim 1, wherein the ink column is separated into ink droplets while varying the mass of the ink droplets based on image information on an image to be formed, wherein ink droplets of smaller mass and ink droplets of greater mass are formed, and the smaller mass ink droplets are caught by the gutter unit and not used for an image forming operation while the greater mass ink droplets are used for an image forming operation.

3. The continuous multi-nozzle inkjet recording apparatus according to claim 1, wherein the gas flow is a cleaned airflow prepared by filtering air.

4. The continuous multi-nozzle inkjet recording apparatus according to claim 1, further comprising a monitoring unit to monitor the ink column, the monitoring unit being disposed near the ink jetting nozzles, wherein the monitoring unit detects curving of a jetting direction of the ink column and a deflection of ink droplets, and an image forming operation of the continuous multi-nozzle inkjet recording apparatus is stopped when the monitoring unit detects at least one of curving of the jetting direction and the deflection.

5. The continuous multi-nozzle inkjet recording apparatus according to claim 4, further comprising a refreshing unit to cover the ink jetting nozzles and to suck ink from the ink jetting nozzles, the refreshing unit being activated upon detection of curving of the jetting direction of the ink column and a deflection of ink droplets by the monitoring unit.

6. A continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, the multi-nozzle inkjet head comprising:

a liquid chamber to supply pressurized ink to the ink jetting nozzles;

an ink nozzle plate, attached to the liquid chamber, including the plurality of ink jetting nozzles arranged in a given direction with a given arrangement density to jet the pressurized ink from the liquid chamber;

a heating unit including a heater having a film structure and disposed in close proximity to each of the plurality of the ink jetting nozzles, the ink jetting nozzles and the heating unit being integrated as a multiple-ink-nozzle plate, the heating unit stimulates the pressurized ink at an exit opening of each of the ink jetting nozzles to separate ink droplets from a leading edge of the ink column jetted from each of the ink jetting nozzles, the separated ink droplets flying in a given direction, the separated ink droplets flying in a given direction;

means for applying a gas flow to the flying ink droplets from a given direction to a flying direction of the flying ink droplets, the means for applying the gas flow including an opening to jet the gas flow;

means for shielding an area of the gas flow from an ambient atmosphere space existing around a transporting and image forming area for the recording medium; and means for guttering disposed between the area of the gas flow and the transporting area of the recording medium to catch ink droplets that change the flying direction with an application of the gas flow to the flying ink droplets, ink droplets not caught by the means for guttering being directed onto the recording medium to form an image on the recording medium.

7. A method of controlling a continuous multi-nozzle inkjet recording apparatus having a multi-nozzle inkjet head including a plurality of ink jetting nozzles to pressurize ink to jet an ink column from each of the ink jetting nozzles continuously, and a transport unit, disposed near the multi-nozzle inkjet head and opposite the ink jetting nozzles, to transport a recording medium in one direction at a given distance from the multi-nozzle inkjet head, the multi-nozzle inkjet head including:

a liquid chamber to supply pressurized ink to the ink jetting nozzles;

an ink nozzle plate, attached to the liquid chamber, including the plurality of ink jetting nozzles arranged in a given direction with a given arrangement density to jet the pressurized ink from the liquid chamber; and a heating unit including a heater having a film structure and disposed in close proximity to each of the plurality of the ink jetting nozzles, the ink jetting nozzles and the heating unit being integrated as a multiple-ink-nozzle plate, the method comprising:

stimulating the pressurized ink at an exit opening of each of the ink jetting nozzles to separate ink droplets from a leading edge of the ink column jetted from each of the ink jetting nozzles, the separated ink droplets flying in a given direction;

applying a gas flow to the flying ink droplets from a given direction to a flying direction of the flying ink droplets using a gas flow applicator, the gas flow applicator including an opening to jet the gas flow;

shielding an area of the gas flow, using a cap, from an ambient atmosphere space existing around a transporting and image forming area for the recording medium; and catching ink droplets, using a gutter unit, that change flying direction with application of the gas flow;

ink droplets not caught by the gutter unit being directed onto the recording medium to form an image on the recording medium.

8. The method according to claim 7, the method further comprising:

detecting curving of a jetting direction of the ink column and a deflection of ink droplets using a monitoring unit being disposed near the ink jetting nozzles; and stopping an image forming operation of the continuous multi-nozzle inkjet recording apparatus when the at least one of curving of the jetting direction and the deflection is detected using the monitoring unit.

* * * * *